US009194067B2

(12) United States Patent
Jimbo et al.

(10) Patent No.: US 9,194,067 B2
(45) Date of Patent: Nov. 24, 2015

(54) SEWING MACHINE

(71) Applicant: BROTHER KOGYO KABUSHIKI KAISHA, Nagoya-shi, Aichi-ken (JP)

(72) Inventors: Masaru Jimbo, Nagoya (JP); Yutaka Nomura, Anjo (JP); Hiroyuki Suzuki, Gamagori (JP); Kentaro Torii, Nagoya (JP); Kazuki Kojima, Nagoya (JP); Daisuke Honda, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/638,645

(22) Filed: Mar. 4, 2015

(65) Prior Publication Data

US 2015/0275410 A1 Oct. 1, 2015

(30) Foreign Application Priority Data

Mar. 28, 2014 (JP) ..... 2014-067853

(51) Int. Cl.
*G06F 7/66* (2006.01)
*D05B 19/06* (2006.01)

(52) U.S. Cl.
CPC ..... *D05B 19/06* (2013.01); *D05D 2205/00* (2013.01)

(58) Field of Classification Search
CPC ..... D05B 19/00; D05B 19/003; D05B 19/02; D05B 19/04; D05B 19/06; D05B 19/08; D05B 19/10; D05B 19/12; D05B 19/14; D05B 19/16; D05C 5/00; D05C 5/02; D05D 2205/00
USPC ..... 700/136–138
See application file for complete search history.

(56) References Cited

U.S. PATENT DOCUMENTS 3,966,331 A * 6/1976 Inuiya ..... 356/391
4,998,489 A * 3/1991 Hisatake et al. ..... 112/103

(Continued)

FOREIGN PATENT DOCUMENTS

JP 2004139191 A 5/2004
JP 2010009542 A 1/2010

(Continued)

OTHER PUBLICATIONS

Feb. 27, 2015 Notice of Allowance issued in U.S. Appl. No. 14/233,031.
U.S. Appl. No. 14/233,031, filed Mar. 24, 2014 in the name of Jimbo et al.

*Primary Examiner* — Nathan Durham
(74) *Attorney, Agent, or Firm* — Oliff PLC

(57) ABSTRACT

A sewing machine includes a coordinate indicator, a processor, and a memory. The coordinate indicator includes a cylindrical housing, a rod-shaped indicating member, a switch, a single transmitter, a receiver, and a flat surface. The memory is configured to store computer-readable instructions. The computer-readable instructions, when executed by the processor, cause the sewing machine to perform processes that include computing a plurality of sets of first coordinates based on a plurality of times at which the receiver receives a ultrasonic wave, computing a movement direction based on at least some of the computed plurality of sets of the first coordinates, computing a movement distance based on at least some of the computed plurality of sets of the first coordinates, and computing second coordinates based on at least some of the plurality of sets of the first coordinates, the movement direction, and the movement distance.

8 Claims, 18 Drawing Sheets

(56) References Cited

U.S. PATENT DOCUMENTS

| | | | | |
|---|---|---|---|---|
| 5,319,565 | A * | 6/1994 | Hausammann et al. | 700/131 |
| 8,528,491 | B2 * | 9/2013 | Bentley | 112/470.04 |
| 2009/0151612 | A1 * | 6/2009 | Bentley | 112/470.04 |
| 2013/0233217 | A1 | 9/2013 | Shimizu et al. | |
| 2013/0233218 | A1 * | 9/2013 | Nishimura et al. | 112/470.06 |
| 2013/0233219 | A1 | 9/2013 | Nakamura et al. | |
| 2013/0233220 | A1 | 9/2013 | Nomura et al. | |
| 2013/0233221 | A1 | 9/2013 | Abe et al. | |
| 2013/0233222 | A1 | 9/2013 | Nishimura et al. | |
| 2014/0290551 | A1 | 10/2014 | Jimbo et al. | |

FOREIGN PATENT DOCUMENTS

| | | | |
|---|---|---|---|
| JP | 2013188261 | A | 9/2013 |
| JP | 2013188262 | A | 9/2013 |
| JP | 2013188263 | A | 9/2013 |
| JP | 2013188264 | A | 9/2013 |
| JP | 2013188265 | A | 9/2013 |
| JP | 2014191692 | A | 10/2014 |

* cited by examiner

SEWING MACHINE

CROSS-REFERENCE TO RELATED APPLICATION

This application claims priority to Japanese Patent Application No. 2014-067853 filed Mar. 28, 2014, the content of which is hereby incorporated herein by reference.

BACKGROUND

The present disclosure relates to a sewing machine.

In related art, a device is known that is configured to identify a position that is indicated by an ultrasound pen that transmits ultrasonic waves.

For example, a known ultrasound pen includes two transmitters. When a user indicates a position on a liquid crystal display panel using the ultrasound pen, a switch that is incorporated in a pen tip is turned on. When the switch is turned on, the two transmitters transmit ultrasonic waves. A receiver is provided in the vicinity of the liquid crystal display panel. The receiver receives the two ultrasonic waves transmitted by the two transmitters. Based on a difference between times at which the receiver receives the two ultrasonic waves, a pen input display device detects an inclination of the pen with respect to the liquid crystal display panel when the position on the liquid crystal display panel is indicated using the pen. The pen input display device identifies the position of the pen tip based on the inclination of the pen.

Further, for example, another known sewing machine can specify a sewing position using an ultrasound pen. When a user presses the pen tip of the ultrasound pen against a bed (when the user indicates a position), a switch of the ultrasound pen is turned on. When the switch is turned on, a transmitter of the ultrasound pen transmits an ultrasonic wave. The sewing machine is provided with a receiver. The receiver receives the ultrasonic wave transmitted by the transmitter. Based on a time at which the transmitter transmits the ultrasonic wave and a time at which the receiver receives the ultrasonic wave, the sewing machine identifies a position of the transmitter on the bed. The position of the transmitter and the position of the pen tip are close to each other. Therefore, the sewing machine assumes that the transmitter and the pen tip are located in the same position, and identifies the indicated position indicated by the pen tip.

SUMMARY

The above-described pen input display device detects the inclination of the pen. Thus, the pen input display device can correct a difference between the indicated position indicated by the pen tip and the position of the transmitter. However, it is necessary to provide the two transmitters in the ultrasound pen.

The above-described sewing machine can identify the indicated position using the single transmitter. However, because of the structure of the ultrasound pen, the position of the transmitter is slightly different from the position of the pen tip. Therefore, when the user indicates a position while tilting the ultrasound pen, depending on the degree of inclination of the ultrasound pen, there may be cases in which it is not possible to ignore the difference between the indicated position indicated by the pen tip and the position of the transmitter.

Embodiments of the broad principles derived herein provide a sewing machine that is capable of accurately computing an indicated point on a flat surface using a single ultrasonic wave transmitter.

Embodiments provide a sewing machine that includes a coordinate indicator, a processor, and a memory. The coordinate indicator includes a cylindrical housing, a rod-shaped indicating member, a switch, a single transmitter, a receiver, and a flat surface. The indicating member includes an indicator end. The indicator end is configured to indicate an indicated point. The indicating member is configured to be housed in the housing. The indicating member is configured to be pressed to move along a longitudinal direction of the housing. The indicating member is configured such that the indicator end protrudes from one end of the housing in the longitudinal direction. The switch is housed in the housing. The switch is configured to be turned on when the indicating member is pressed. The single transmitter is housed in the housing. The transmitter is configured to transmit an ultrasonic wave a plurality of times while the switch is on. The receiver is configured to receive the ultrasonic wave transmitted by the transmitter. The flat surface is configured to be indicated by the indicator end. The memory is configured to store computer-readable instructions. The computer-readable instructions, when executed by the processor, cause the sewing machine to perform processes that include computing a plurality of sets of first coordinates based on a plurality of times at which the receiver receives the ultrasonic wave, the plurality of sets of the first coordinates being coordinates of a plurality of positions, on the flat surface, of the transmitter that transmits the ultrasonic wave, computing a movement direction based on at least some of the computed plurality of sets of the first coordinates, the movement direction being a movement direction of the transmitter on the flat surface in which the transmitter is moved along the longitudinal direction while the switch is on, computing a movement distance based on at least some of the computed plurality of sets of the first coordinates, the movement distance being a movement distance on the flat surface by which the transmitter is moved along the longitudinal direction while the switch is on, and computing second coordinates based on at least some of the plurality of sets of the first coordinates, the movement direction, and the movement distance. The second coordinates is coordinates of the indicated point. The indicated point is a position on the flat surface indicated by the indicator end.

BRIEF DESCRIPTION OF THE DRAWINGS

Embodiments will be described below in detail with reference to the accompanying drawings in which.

DETAILED DESCRIPTION

Configuration of a Sewing Machine 101

Figure 1:
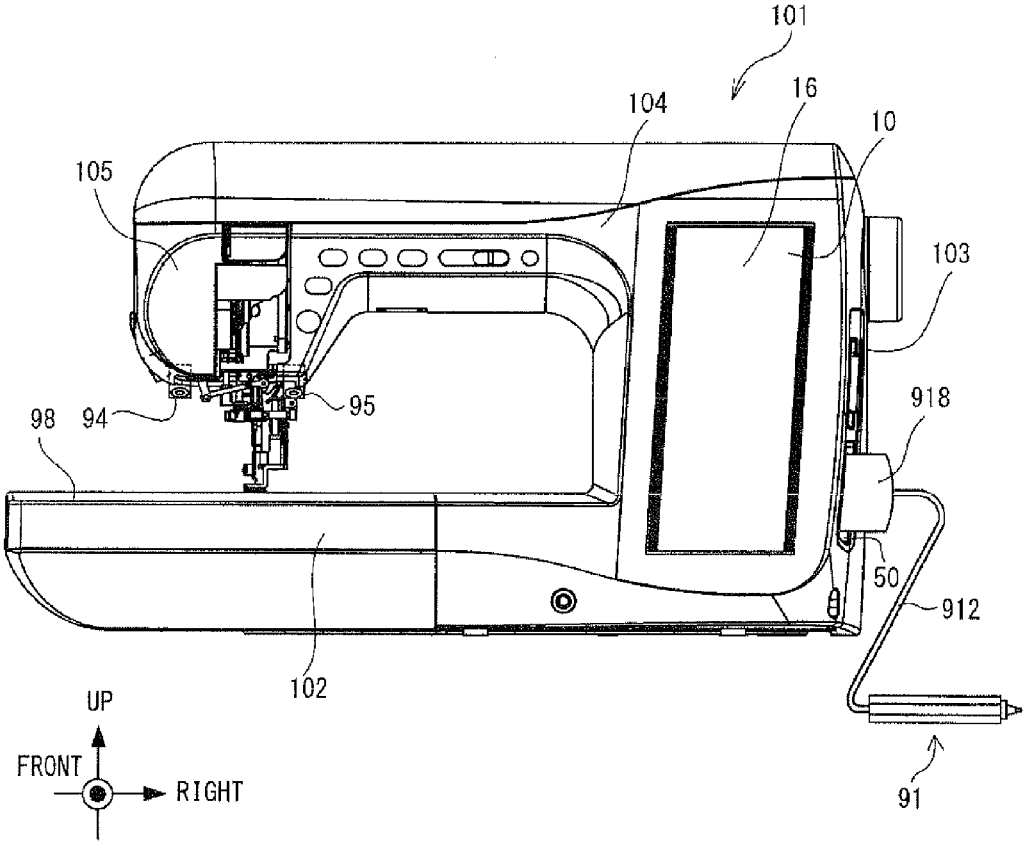
FIG. 1 is a front view of a sewing machine.

A configuration of the sewing machine 101 according to an embodiment will be explained with reference to FIG. 1.

The sewing machine 101 includes a bed 102, a pillar 103, an arm 104, and a head 105. The bed 102 is a base portion of the sewing machine 101. The bed 102 includes a bed surface 98 on which a work cloth 100 can be placed. The bed surface 98 is a flat surface that can be indicated by an indicator end 911 of a coordinate indicator 91. The pillar 103 extends from the bed 102. The arm 104 extends horizontally from the pillar 103 such that the arm 104 is opposed to the bed 102. The head 105 is provided on the end of the arm 104.

The direction in which the pillar 103 extends from the bed 102 is the up direction, and the opposite direction from the up direction is the down direction. The direction in which the arm 104 extends from the pillar 103 is the left direction, and the opposite direction from the left direction is the right direction. The front-rear direction is the direction that is orthogonal to the left-right direction and to the up-down direction.

The sewing machine 101 further includes receivers 94 and 95, a liquid crystal display (LCD) 10, a touch panel 16, connectors 50 and 918, a cable 912, and the coordinate indicator 91.

Above the bed surface 98, the receivers 94 and 95 can receive an ultrasonic wave transmitted by the coordinate indicator 91. The receiver 94 is provided in the left rear part of the bottom face of the head 105. The receiver 95 is provided in the right rear part of the bottom face of the head 105. The left-right distance between the receivers 94 and 95 is the width of the head 105 in the left-right direction.

The LCD 10 is provided on the front face of the pillar 103. The LCD 10 can display various types of items, such as a command, an illustration, a setting value, a message, and the like, for example. The touch panel 16 is provided on the surface of the LCD 10. Specifically, the touch panel 16 is provided on the front face of the LCD 10. The touch panel 16 is used to set an item. When a user uses a finger or a special touch pen to press the touch panel 16, the touch panel 16 can detect the pressed position. The setting means that the sewing machine 101 recognizes the item selected from among a plurality of items, based on the detected pressed position. By pressing the touch panel 16, the user is able to select a pattern to be sewn or a command to be executed.

The connector 50 is provided on the right side face of the pillar 103. The connector 50 may be electrically connected to the connector 918 that is on the coordinate indicator 91 side. The connector 918 may be connected to the cable 912 that extends from the coordinate indicator 91. The sewing machine 101 may supply electric power to the coordinate indicator 91 through the connector 50, the connector 918 and the cable 912.

Explanation of the Coordinate Indicator 91

Figure 2:
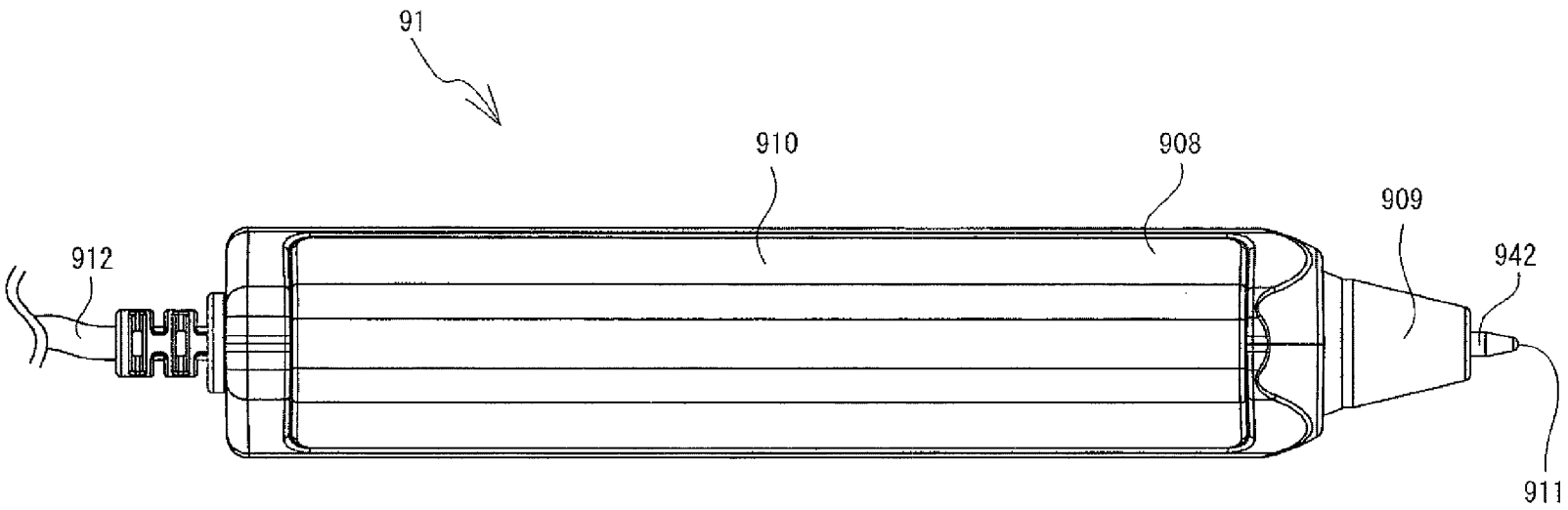
FIG. 2 is a plan view showing an exterior appearance of a coordinate indicator.

The coordinate indicator 91 will be explained with reference to FIG. 2. The coordinate indicator 91 includes a housing 910 and an indicating member 942. The coordinate indicator 91 has a pen shape.

The housing 910 has a cylindrical shape and extends in a longitudinal direction. The housing 910 houses the indicating member 942 in a state in which the indicator end 911 of the indicating member 942 protrudes from one end of the housing 910. The housing 910 includes a grip portion 908 and a holding portion 909

The grip portion 908 has a cylindrical shape and extends in the longitudinal direction. The holding portion 909 holds a transmitter 915. The holding portion 909 is fitted into one end in the longitudinal direction of the grip portion 908. The cable 912 is arranged on the other end in the longitudinal direction of the grip portion 908.

The holding portion 909 has a conical shape and extends in the longitudinal direction. The holding portion 909 tapers such that one end is narrower than the other end. The indicating member 942 penetrates the interior of the holding portion 909, and protrudes from the one end of the holding portion 909.

The indicating member 942 has a rod shape and extends in the longitudinal direction. The indicator end 911 is one end in the longitudinal direction of the indicating member 942. The indicating member 942 can be pressed to move in the longitudinal direction of the housing 910. The indicator end 911 tapers such that its diameter reduces as the indicator end 911 is separated from the other end of the indicating member 942.

Figure 3:
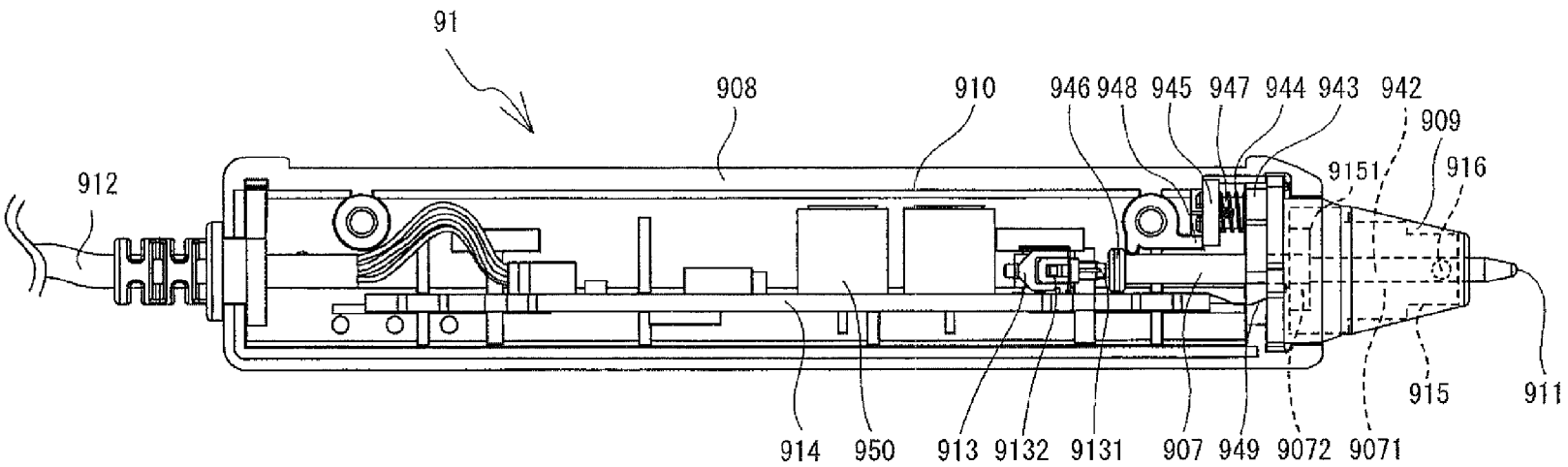
FIG. 3 is a partial cross-sectional view showing an internal structure of the coordinate indicator.

An internal structure of the coordinate indicator 91 will be explained with reference to FIG. 3.

The housing 910 houses the transmitter 915, a switch 913, sections of the indicating member 942 that are not in the vicinity of the indicator end 911, and a signal output circuit board 914. The indicating member 942 is attached to the housing 910 so as to be movable in the longitudinal direction, such that the indicating member 942 is retracted toward the other end side of the housing 910 when an indicated point 936 is pressed and indicated by the indicator end 911. The indicated point 936 is a position on the flat surface (the work cloth 100 or the bed surface 98) that is pressed and indicated by the indicator end 911 of the coordinate indicator 91.

The indicating member 942 includes the indicator end 911, a shaft portion 907, an end portion 946, a flat plate portion 943, a protruding portion 947, a ring 945, and a spring 944.

The shaft portion 907 extends in the longitudinal direction from the indicator end 911. The length of the shaft portion 907 in the longitudinal direction is longer than the length of the holding portion 909 in the longitudinal direction. The shaft portion 907 includes a small diameter portion 9071 and a large diameter portion 9072. The small diameter portion 9071 is located on one end side in the longitudinal direction of the shaft portion 907. The large diameter portion 9072 is located on the other end side in the longitudinal direction of the shaft portion 907.

The end portion 946 is provided on an opposite side to the indicator end 911 in the longitudinal direction of the indicating member 942. In other words, the end portion 946 is provided on the other end of the indicating member 942.

The flat plate portion 943 is provided in a central portion in the longitudinal direction of the indicating member 942. The flat plate portion 943 has a surface that spreads in the radial direction from the shaft portion 907.

The protruding portion 947 extends in the longitudinal direction from a surface on the other end side of the flat plate portion 943.

The ring 945 is slidably provided on the other end side of the protruding portion 947. The protruding portion 947 is inserted into the ring 945. The ring 945 is in contact with an inner wall 948 of the grip portion 908.

The spring 944 is a compression coil spring. The spring 944 is provided between the flat plate portion 943 and the ring 945 such that the spring 944 is compressed around the protruding portion 947. The spring 944 urges the flat plate portion 943 to the one end side from the surface on the other end side of the flat plate portion 943.

Since the spring 944 urges a surface on the one end side of the flat plate portion 943, the ring 945 restricts the indicating member 942 from moving to the other end side in the longitudinal direction with respect to the grip portion 908.

The transmitter 915 is housed on one end side of the housing 910. The transmitter 915 is provided in the vicinity of the indicator end 911 inside the holding portion 909. In more detail, the transmitter 915 is held by an inner wall of the holding portion 909 and is fixed. The single transmitter 915 is provided. The transmitter 915 can transmit the ultrasonic wave a plurality of times while the switch 913 is on. The transmitter 915 can transmit the ultrasonic wave from a transmission position 916 of the transmitter 915. The transmitter 915 is cylindrically shaped and has a hole into which the indicating member 942 can be inserted. The hole of the transmitter 915 penetrates the transmitter 915 in the longitudinal direction. The indicating member 942 penetrates the interior of the transmitter 915 from the other end of the transmitter 915, and protrudes from one end of the transmitter 915. The inner diameter on the one end side of the hole of the transmitter 915 is slightly larger than the diameter of the small diameter portion 9071 of the shaft portion 942. Therefore, when the indicating member 942 is pressed, the indicating member 942 is moved in the longitudinal direction. Further, the hole of the transmitter 915 restricts the indicating member 942 from moving in the radial direction that is orthogonal to the longitudinal direction. The inner diameter on the other end side of the hole of the transmitter 915 is larger than the diameter of the large diameter portion 9072. Therefore, when the surface on one end side of the large diameter portion 9072 comes into contact with an inner wall surface 9151, which is a boundary between the one end side and the other end side of the transmitter 915, the movement of the indicating member 942 to the one end side is restricted.

The signal output circuit board 914 is an electronic board that is disposed along the longitudinal direction inside the grip portion 908. The signal output circuit board 914 has a flat plate shape. The signal output circuit board 914 is engaged with a rib that protrudes to the inside of the grip portion 908, and is fixed. While the switch 913 is on, the signal output circuit board 914 outputs a signal indicating that the switch 913 is on, to a control portion 60 via the cable 912.

A flexible printed circuit (FPC) 949 electrically connects the signal output circuit board 914 and the transmitter 915. The FPC 949 extends from one end side of the signal output circuit board 914 toward the transmitter 915, and is bonded to the transmitter 915.

A capacitor portion 950 is provided on the signal output circuit board 914. The capacitor portion 950 is electrically connected to the signal output circuit board 914. The capacitor portion 950 stores energy that causes the ultrasonic wave to be transmitted from the transmitter 915. When a control signal is transmitted from a CPU 61 to the signal output circuit board 914, the capacitor portion 950 outputs the energy stored in the capacitor portion 950 to the transmitter 915 via the signal output circuit board 914 and the FPC 949. The transmitter 915 receives the energy from the capacitor portion 950 and transmits the ultrasonic wave.

The switch 913 is fixed to the surface of the signal output circuit board 914 such that the switch 913 faces the end portion 946. The switch 913 is housed in the housing 910, and is turned on when the indicating member 942 is pressed. The switch 913 includes a movable portion 9131 and a main body portion 9132.

The main body portion 9132 can transmit, to the signal output circuit board 914, a signal indicating that the switch 913 is turned on. The main body portion 9132 is fixed to the signal output circuit board 914.

The movable portion 9131 protrudes from one end side of the main body portion 9132. The movable portion 9131 faces the end portion 946 and is provided so as to be movable in the longitudinal direction. Therefore, even when the end portion 946 presses the movable portion 9131 and the switch 913 is turned on, the indicating member 942 can be moved to the other end side until the spring 944 is compressed to a maximum extent.

The operation of pressing the indicating member 942 will be explained with reference to FIG. 4A to FIG. 4C.

Figure 4A:
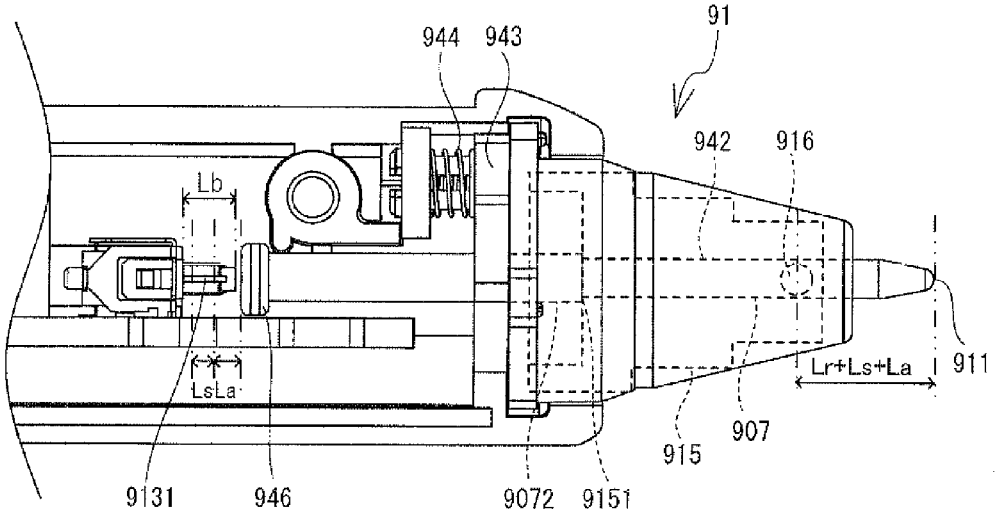
FIG. 4A is a partial cross-sectional view showing the coordinate indicator in a state in which an indicator end is not pressed.

As shown in FIG. 4A, when the indicator end 911 of the coordinate indicator 91 is not pressed, the end portion 946 is not in contact with the movable portion 9131. The spring 944 urges the flat plate portion 943 to the one end side. Therefore, when the indicator end 911 is not pressed, the indicator end 911 is located as far as possible to the one end side. When the indicator end 911 is moved to the one end side, the surface on the one end side of the large diameter portion 9072 of the shaft portion 907 comes into contact with the inner wall surface 9151 of the transmitter 915. Therefore, the position at which the large diameter portion 9072 of the shaft portion 907 is in contact with the inner wall surface 9151 of the transmitter 915 is a position at which the indicator end 911 protrudes as far as possible to the one end side.

The user may use the indicator end 911 to indicate and press the indicated point 936 on the bed surface 98. In this case, as shown in FIG. 4B, the end portion 946 of the indicating member 942 is moved by a distance La toward the movable portion 9131 of the switch 913 in the longitudinal direction. The distance La is 3 mm, for example. The end portion 946 is moved to the other end side by the distance La from the position in which the indicator end 911 is not pressed, and comes into contact with the movable portion 9131. In this state, the switch 913 is turned on. As the indicating member 942 is pressed to move, the flat plate portion 943 is moved to the other end side. The ring 945 is in contact with one end side of the inner wall 948. Therefore, the leading end of the protruding portion 947 protrudes further to the other end side than the ring 945. As the leading end of the protruding portion 947 protrudes further to the other end side than the ring 945, the spring 944, which is between the ring 945 and the flat plate portion 943, is compressed. The transmitter 915 is held by the holding portion 909. Therefore, even when the indicating member 942 is pressed to move, the transmission position 916 in the holding portion 909 is not moved.

Figure 4B:
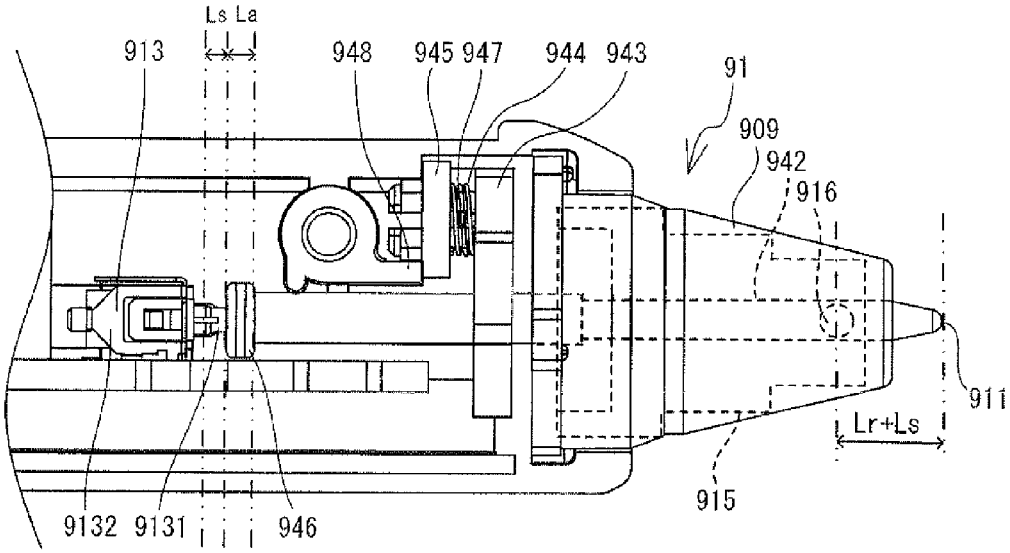
FIG. 4B is a partial cross-sectional view showing the coordinate indicator in a state in which the indicator end is pressed.
Figure 4C:
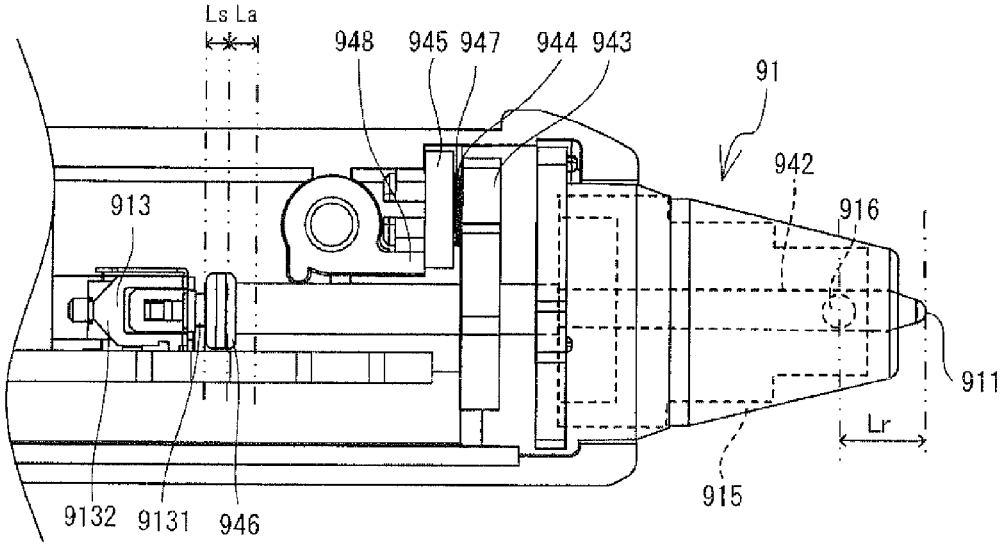
FIG. 4C is a partial cross-sectional view showing the coordinate indicator in a state in which the indicator end is further pressed.

As shown in FIG. 4C, in a state in which the end portion 946 is in contact with the movable portion 9131 while the switch 913 is still on, the end portion 946 may further be moved by a distance Ls to the other end side. When the end portion 946 is moved by the distance Ls to the other end side, the flat plate portion 943 is moved to the other end side. The ring 945 is in contact with the one end side of the inner wall 948. Therefore, the leading end of the protruding portion 947 protrudes even further to the one end side than the ring 945. As the leading end of the protruding portion 947 protrudes even further to the other end side than the ring 945, the spring 944 between the ring 945 and the flat plate portion 943 is compressed to the maximum extend. The spring 944 urges the flat plate portion 943 to the one end side, and thus restricts the indicating member 942 from moving to the other end side. The distance Ls is 2.5 mm, for example. When the spring 944 is compressed to the maximum extend, the indicator end 911 of the coordinate indicator 91 is pressed as far as possible to the other end side. In this case, the distance between the transmission position 916 and the indicator end 911 is Lr. The distance Lr is 4 mm, for example. A movable range Lb of the movable portion 9131 is longer than a distance (Ls+La). Therefore, there is no possibility that the end portion 946 presses the main body portion 9132. The transmitter 915 is held by the holding portion 909. Therefore, even when the indicating member 942 is pressed to move as far as possible to the other end side, the transmission position 916 is not moved.

As shown in FIG. 4B, when the pressing of the indicator end 911 is released, the urging force of the spring 944 causes the indicating member 942 to be moved by the distance Ls toward the one end side. When the indicating member 942 is moved toward the one end side by the distance Ls from the side closest to the other end, the movable portion 9131 returns and the switch 913 is turned off. When the switch 913 is turned off, the distance between the transmission position 916 and the indicator end 911 is a distance (Lr+Ls).

As shown in FIG. 4A, the switch 913 is turned off, and the urging force of the spring 944 may further cause the indicating member 942 to be moved by the distance La to the one end side. In this case, the inner wall surface 9151 of the transmitter 915 comes into contact with the large diameter portion 9072 of the shaft portion 907. Therefore, the movement of the indicating member 942 to the one end side is restricted. At this time, the distance between the transmission position 916 and the indicator end 911 is the distance (Ls+La).

Although details will be described below, the receivers 94 and 95 can receive the ultrasonic wave transmitted by the transmitter 915. Based on the ultrasonic wave received by the receivers 94 and 95, the sewing machine 101 can identify a transmission source of the ultrasonic wave, namely, the transmission position 916 of the transmitter 915 provided in the coordinate indicator 91. The sewing machine 101 can perform sewing based on the identified position. For example, the user may press the indicator end 911 of the coordinate indicator 91 against the work cloth 100, and thus sewing may be performed at the position indicated on the work cloth 100.

Explanation of the Receiver 94

Figure 5:
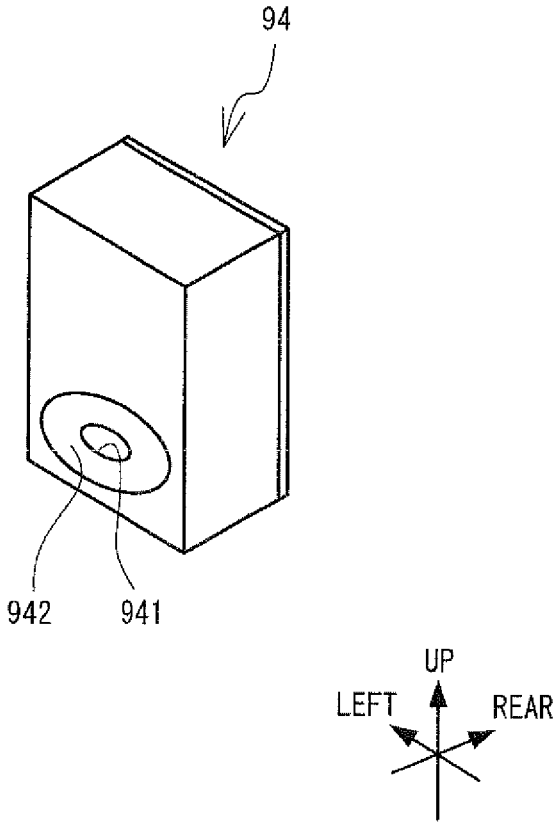
FIG. 5 is a perspective view of a receiver.

The receiver 94 will be explained in detail with reference to FIG. 5. The receiver 95 has the same structure as the receiver 94 and an explanation thereof is thus omitted. The receiver 94 has a cuboid shape that is long in the up-down direction. An opening portion 941 is provided at the center of a lower end portion of the front face of the receiver 94. The opening portion 941 has an elliptical shape that is long in the left-right direction. A periphery 942 of the opening portion 941 is a tapered surface that is radially inclined toward the front side. An electric board and a microphone are provided inside the receiver 94. The microphone is located on an inner side of the opening portion 941. A receiver connector is provided on a rear surface of the upper end of the electric board. The receiver connector is connected to a connector that is provided on the sewing machine 101. The directionality of the receiver 94 is defined by the orientation of the opening portion 941 with respect to the microphone.

Electrical Configuration of the Sewing Machine 101

Figure 6:
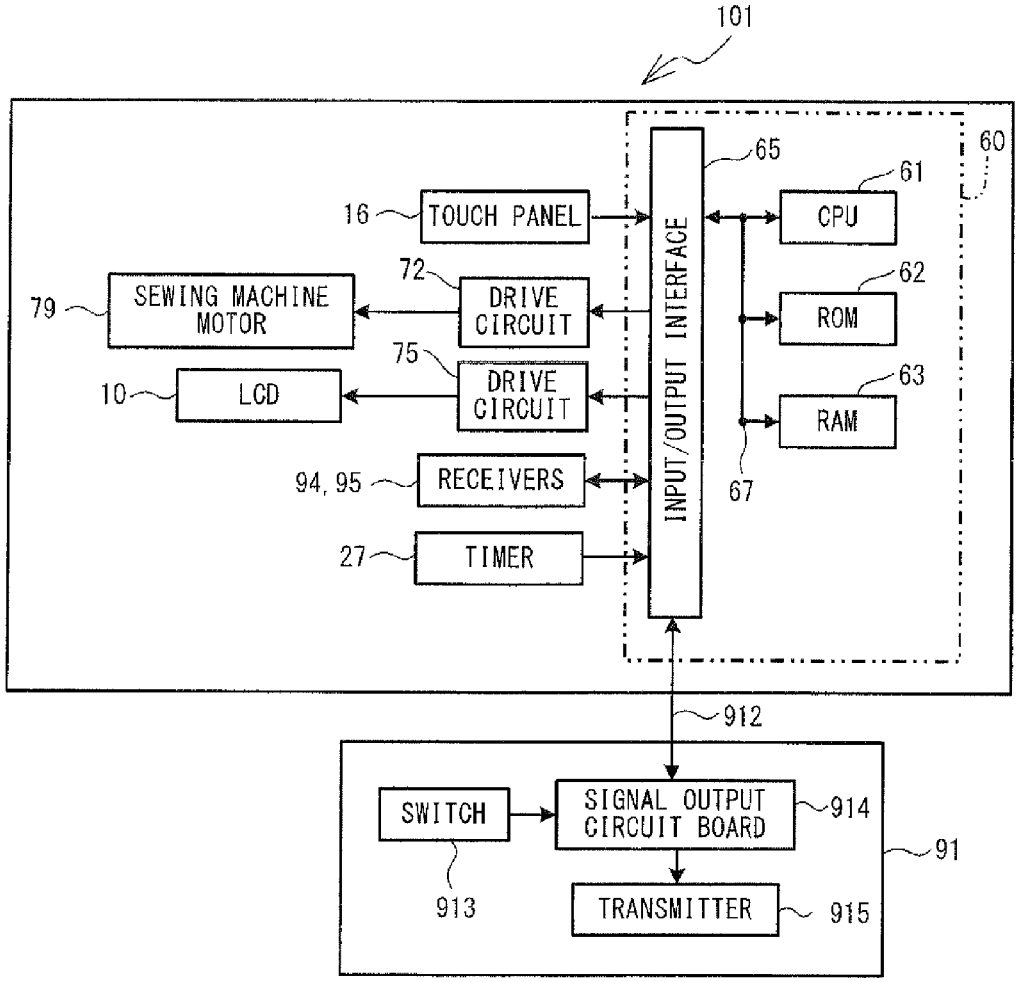
FIG. 6 is a block diagram showing an electrical configuration of the sewing machine.

An electrical configuration of the sewing machine 101 will be explained with reference to FIG. 6. The control portion 60 of the sewing machine 101 includes the CPU 61, a ROM 62, a RAM 63, and an input/output interface 65. The CPU 61, the ROM 62, the RAM 63, and the input/output interface 65 are electrically connected to each other via a bus 67. The ROM 62 stores various types of programs including a coordinate computation program 500, data, etc.

The touch panel 16, a timer 27, the receivers 94 and 95 and drive circuits 72 and 75 are electrically connected to the input/output interface 65. The timer 27 can measure time. The drive circuits 72 and 75 can drive a sewing machine motor 79 and the LCD 10, respectively.

The coordinate indicator 91 includes the switch 913, the signal output circuit board 914 and the transmitter 915. The switch 913 is electrically connected to the signal output circuit board 914. The signal output circuit board 914 may be electrically connected to the input/output interface 65. The switch 913 is turned on and off when the end portion 946 presses the movable portion 9131. When the switch 913 is in an off state, the signal output circuit board 914 outputs a high signal to the CPU 61 via the cable 912 and the input/output interface 65. When the switch 913 is turned on, the signal output circuit board 914 outputs a low signal to the CPU 61 via the cable 912 and the input/output interface 65. Hereinafter, the low signal that is output by the signal output circuit board 914 is referred to as an indication signal. The switch 913, the signal output circuit board 914, and the transmitter 915 are provided inside the housing 910. The signal output circuit board 914 can receive, from the CPU 61, a control signal that instructs transmission of the ultrasonic wave and can cause the transmitter 915 to transmit the ultrasonic wave.

Structures of Data

Structures of data that are stored in the ROM 62 and the RAM 63 will be explained with reference to FIG. 7A and FIG. 7B.

Figure 7A:
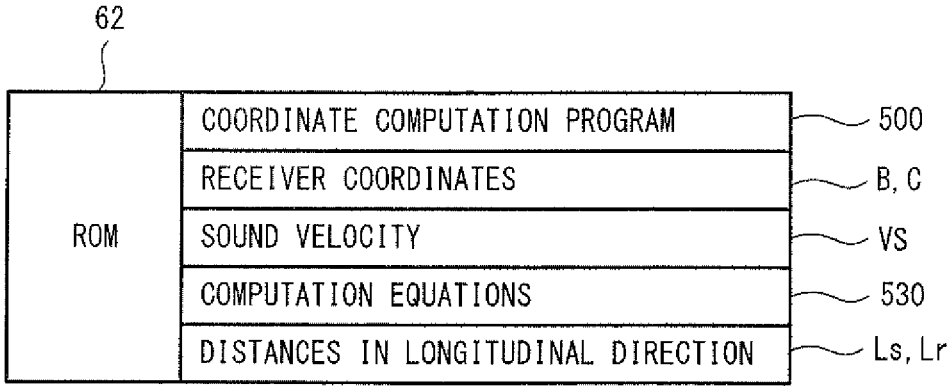
FIG. 7A is an explanatory diagram showing a structure of data stored in a ROM.

As shown in FIG. 7A, the ROM 62 stores the coordinate computation program 500, receiver coordinates B and C, a sound velocity VS, computation equations 530, and the distances Ls and Lr in the longitudinal direction. The coordinate computation program 500 is a program to execute main processing that will be described below and various types of processing in the main processing. The receiver coordinates B and C, the sound velocity VS, and the computation equations 530 may be read out from the ROM 62 in a case where coordinates E of the transmitter 915 are computed.

Figure 7B:
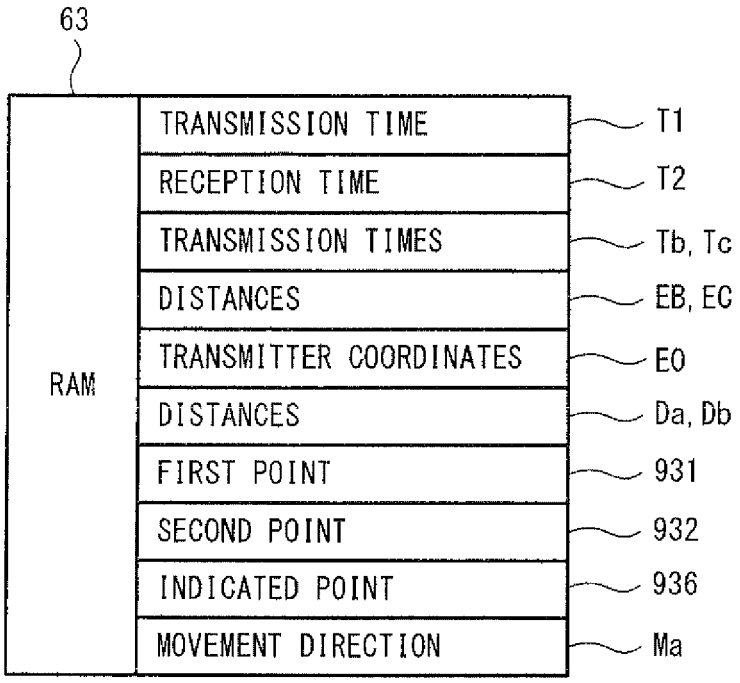
FIG. 7B is an explanatory diagram showing a structure of data stored in a RAM.

As shown in FIG. 7B, the RAM 63 functions as a temporary storage area that stores various variables and the like that are referred to when the CPU 61 executes the coordinate computation program 500 stored in the ROM 62. The various variables include, for example, a transmission time T1, a reception time T2, transmission times Tb and Tc, distances EB and EC, coordinates E0 of the transmitter 915 on the flat surface, distances Da and Db, a first point 931, a second point 932, the indicated point 936, and a movement direction Ma.

Figure 8:
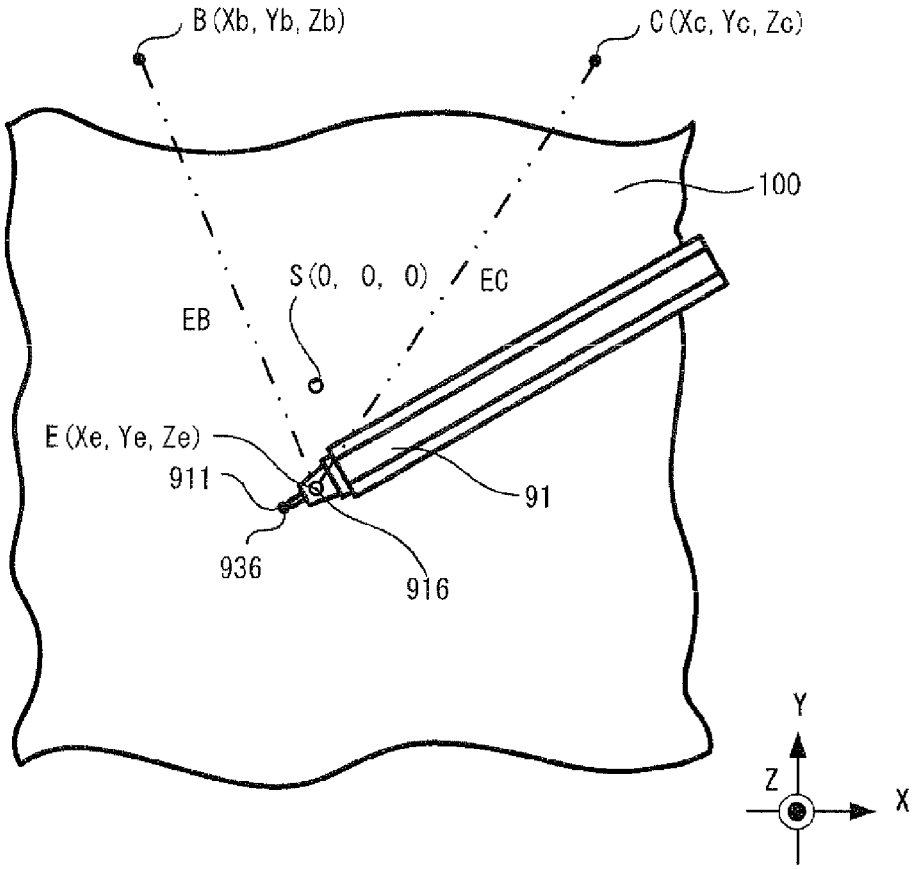
FIG. 8 is a view illustrating a method for computing transmitter coordinates.
Figure 9:
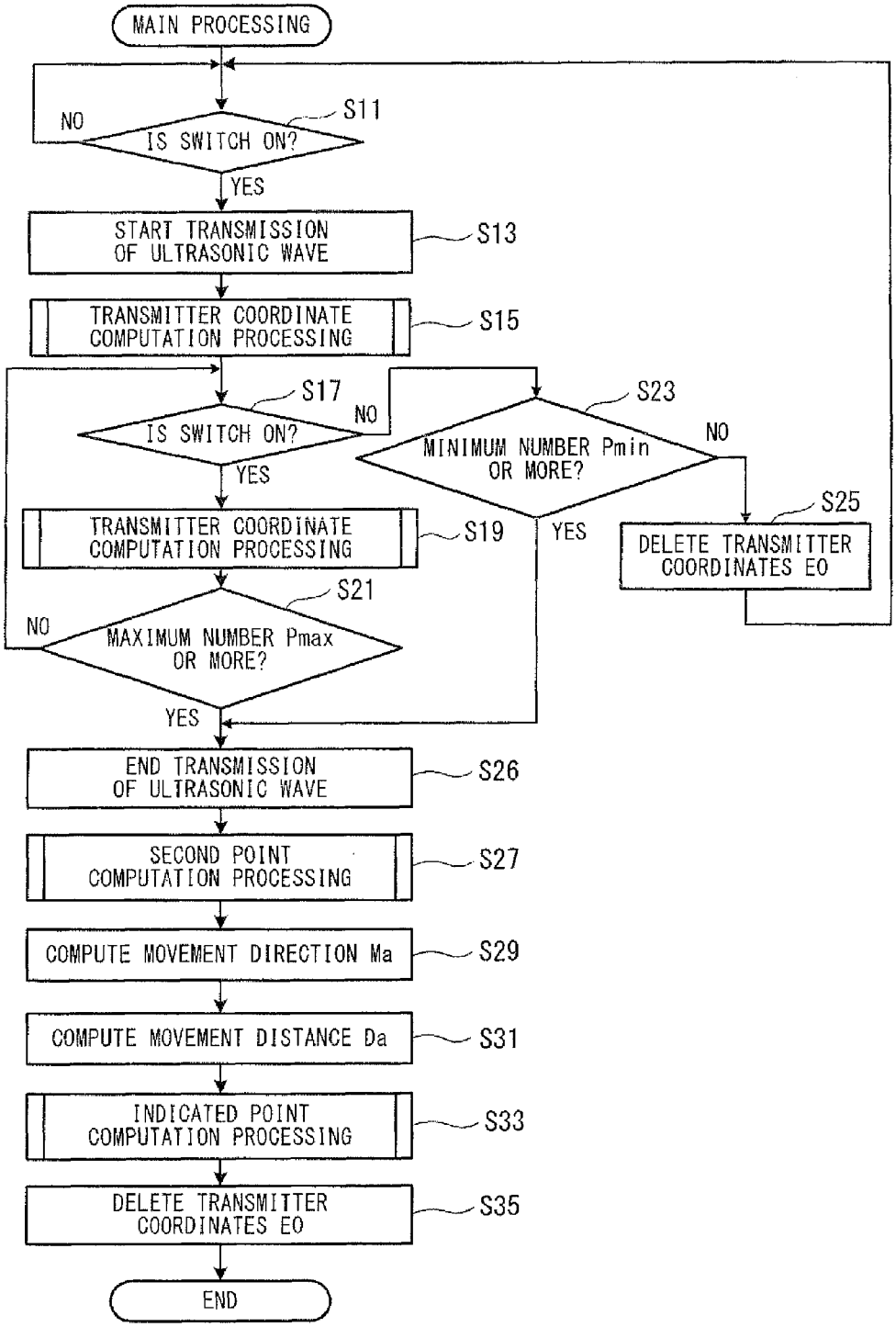
FIG. 9 is a flowchart showing main processing.

Method for computing coordinates of the transmitter 915 A method for identifying the coordinates E of the transmitter 915 will be explained with reference to FIG. 8. The user may cause the indicator end 911 of the coordinate indicator 91 to come into contact with the work cloth 100, and causes the indicating member 942 to be pressed. In this manner, the switch 913 is turned on, and thus the indicated point 936 on the work cloth 100 at which sewing is to be performed by the sewing machine 101 is indicated. The sewing machine 101 can identify the coordinates E of the transmitter 915 and thus can identify the indicated point 936. The coordinates E of the transmitter 915 are different from the indicated point 936 on the work cloth 100 with which the indicator end 911 is in contact. Therefore, it is necessary to correct a difference between the coordinates of the indicated point 936 indicated by the indicator end 911 and the coordinates E of the transmitter 915, by the main processing that will be described later. Hereinafter, the left-right direction, the front-rear direction, and the up-down direction of the sewing machine 101 are defined as the X direction, the Y direction, and the Z direction, respectively.

The sewing machine 101 identifies the coordinates E of the transmitter 915 in the form of (X coordinate, Y coordinate, Z coordinate). An origin point S (0, 0, 0) for the coordinates is defined as the center point of a needle hole that is formed in a needle plate and through which a sewing needle passes. The plane at which the Z coordinate is zero indicates the top face of the needle plate. Coordinates B that indicate the position of the receiver 94 are defined as (Xb, Yb, Zb). Coordinates C that indicate the position of the receiver 95 are defined as (Xc, Yc, Zc). The coordinates E of the transmitter 915 are defined as (Xe, Ye, Ze). Hereinafter, the coordinates E is called the transmitter coordinates E. The Z coordinates for the receivers 94 and 95 indicate the heights of the receivers 94 and 95 in relation to the top face of the needle plate. The distance between the transmitter coordinates E and the coordinates B is called the distance EB. The distance between the transmitter coordinates E and the coordinates C is called the distance EC.

Based on the Pythagorean theorem, the distances EB and EC can be described by the coordinates B, C, and E. The distance EB and the coordinates B and E satisfy the relationship that is described by Equation (1) below. In the same manner, the distance EC and the coordinates C and E satisfy the relationship that is described by Equation (2) below.

$$(Xb-Xe)^2+(Yb-Ye)^2+(Zb-Ze)^2=(EB)^2 \quad \text{Equation (1):}$$

$$(Xc-Xe)^2+(Yc-Ye)^2+(Zc-Ze)^2=(EC)^2 \quad \text{Equation (2):}$$

Equation (1) is identical to an equation for a spherical surface for which the coordinates B define the center point, that has a radius of the distance EB, and that intersects the transmitter coordinates E. In the same manner, Equation (2) is identical to an equation for a spherical surface for which the coordinates C define the center point, that has a radius of the distance EC, and that intersects the transmitter coordinates E.

The velocity at which the ultrasonic wave travels is the sound velocity VS. The time that is required for the ultrasonic wave that is transmitted from the coordinate indicator 91 that is at the transmitter coordinates E to arrive at the receiver 94 is defined as the transmission time Tb. The time that is required for the ultrasonic wave that is transmitted from the coordinate indicator 91 that is at the transmitter coordinates E to arrive at the receiver 95 is defined as the transmission time Tc. In this case, the distances EB and EC can respectively be described by Equations (3) and (4) below.

$$EB=VS\times Tb \quad \text{Equation (3):}$$

$$EC=VS\times Tc \quad \text{Equation (4):}$$

Substituting Equations (3) and (4) into Equations (1) and (2) yields Equations (5) and (6) below.

$$(Xb-Xe)^2+(Yb-Ye)^2+(Zb-Ze)^2=(VS\times Tb)^2 \quad \text{Equation (5):}$$

$$(Xc-Xe)^2+(Yc-Ye)^2+(Zc-Ze)^2=(VS\times Tc)^2 \quad \text{Equation (6):}$$

In Equations (5) and (6), the coordinates B (Xb, Yb, Zb), the coordinates C (Xc, Yc, Zc), and the sound velocity VS are known values, which are stored in advance in the ROM 62. Equations (1) to (6) are stored in the ROM 62 in advance as the computation equations 530. The transmission times Tb and Tc can be identified by computing the differences between the time at which the ultrasonic wave is transmitted from the transmitter 915 of the coordinate indicator 91 and the individual times at which the ultrasonic wave is received by the receivers 94 and 95. Hereinafter, the time at which the ultrasonic wave is transmitted from the transmitter 915 of the coordinate indicator 91 is called the transmission time T1. Hereinafter, the times at which the ultrasonic wave is received by the receivers 94 and 95, respectively, are called the reception times T2.

The value for the thickness of the work cloth 100 is so much smaller than the values for Xe and Ye that the value for the thickness can be ignored. Therefore, among the transmitter coordinates E (Xe, Ye, Ze), Ze may be regarded as a constant Ki that is a virtual distance between the transmitter 915 and the indicator end 911. Accordingly, the respective values for Xe and Ye can be computed based on the simultaneous Equations (5) and (6). The computed transmitter coordinates E (Xe, Ye, Ki) are caused to slide to the bed surface 98, and are taken as the coordinates E0 (Xe, Ye, 0) on the flat surface.

The constant Ki will be explained in detail. When the user indicates the indicated point 936 using the coordinate indicator 91, an average angle θ between the flat surface and the longitudinal direction of the coordinate indicator 91 is 60 degrees. When the user indicates the indicated point 936, an average distance from the indicator end 911 to the transmitter 915 in the longitudinal direction is a distance from an intermediate position to the transmitter 915. The intermediate position is a intermediate position between the position of the indicator end 911 when the transmitter 915 first transmits the ultrasonic wave and the position of the indicator end 911 when the indicating member 942 is pushed to the maximum extent. When the indicator end 911 is located at the intermediate position, the distance from the indicator end 911 to the transmitter 915 is Lr+Ls/2. Based on the above-described angle θ and distances, the constant Ki is obtained as Ki $(Lr+(Ls/2))\times\sin\theta=(4+(2.5/2))\times\sqrt{3}/2\approx4.5$.

Main Processing

The main processing will be explained with reference to FIG. 9 to FIG. 13. The main processing is performed by the CPU 61 in accordance with the coordinate computation program 500. The main processing may be performed when the user selects an ultrasonic wave mode using the touch panel 16. Each of the steps that are shown in a flowchart of the main processing shows processing by the CPU 61.

At step S11, the CPU 61 determines whether the switch 913 has been turned on. When it is determined that the switch 913 has been turned on (yes at step S11), the CPU 61 advances the processing to step S13. When it is determined that the switch 913 has not been turned on (no at step S11), the CPU 61 repeats the processing at step S11.

At step S13, the CPU 61 starts to cause the transmitter 915 to transmit the ultrasonic wave every time a specified time period UT elapses. In processing to be described below, the CPU 61 computes a movement trajectory of the transmitter 915 due to the indicating member 942 being pressed and moved, based on the transmission position 916 of the transmitter 915 from which the ultrasonic wave is transmitted every time the specified time period UT elapses. Thus, the CPU 61 can compute a movement direction Ma and a movement distance Da, which will be described below. The movement trajectory is distribution of the coordinates on the bed surface 98 of the transmitter 915 that transmits the ultrasonic wave every time the specified time period UT elapses. Specifically, the CPU 61 refers to the timer 27 and outputs to the signal output circuit board 914 a control signal that instructs the transmitter 915 to transmit the ultrasonic wave every time the specified time period UT elapses. The signal output circuit board 914 receives the control signal from the CPU 61, and causes the transmitter 915 to transmit the ultrasonic wave every time the specified time period UT elapses. The specified time period UT is 6 milliseconds, for example.

Figure 11:
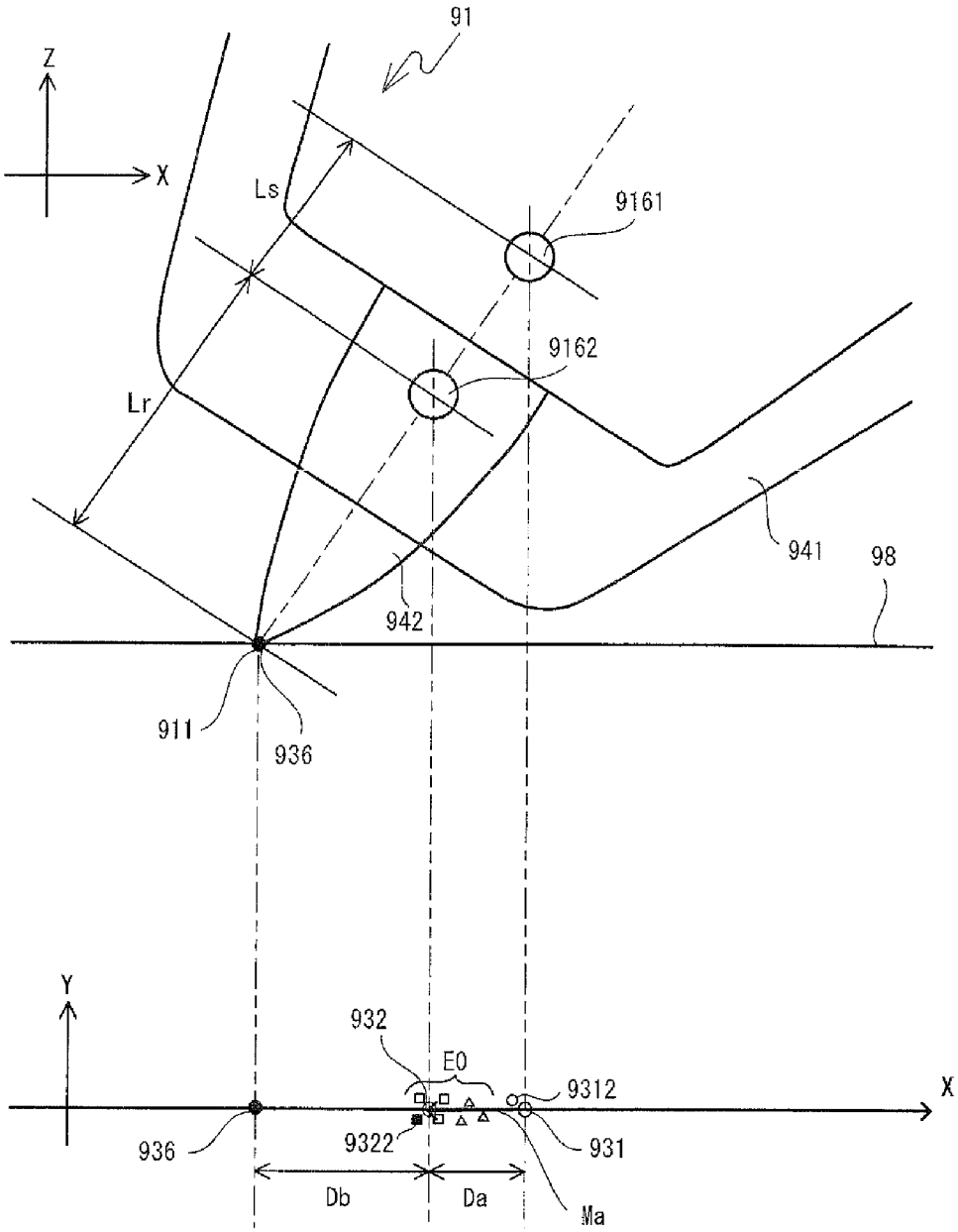
FIG. 11 is a side view of an area including the indicator end of the coordinate indicator, and a plan view showing distribution of transmitter coordinates on a bed surface.

At step S15, the CPU 61 performs transmitter coordinate computation processing. In the transmitter coordinate computation processing, in order to compute the first point 931, the CPU 61 computes the coordinates E0 on the flat surface from which the transmitter 915 transmits the ultrasonic wave for the first time after the switch 913 is turned on. The first point 931 is a position on the flat surface that corresponds to the transmission position 916 when the indicating member 942 protrudes as far as possible to the one end side while the switch 913 is in an on state. The CPU 61 computes the coordinates E0, on the flat surface, of the transmitter 915 that transmitted the ultrasonic wave, based on the plurality of times T2 at which the receivers 94 and 95 receives the ultrasonic wave. The CPU 61 stores the computed coordinates in the RAM 63 as the first point 931. In FIG. 11, the first point 931, which is the transmission position from which the transmitter 915 transmits the ultrasonic wave for the first time, is denoted by a circle. A transmission position 933 from which the transmitter 915 transmits the ultrasonic wave for the last time is also denoted by a circle. The first point 931 is a position on the flat surface that corresponds to a transmission position 9161 from which the transmitter 915 transmits the ultrasonic wave for the first time after the switch 913 is turned on. That is, the first point 931 represents coordinates on the bed surface 98 of the transmitter 915 that transmits the ultrasonic wave while the switch 913 is on. The first point 931 is (8, 0, 0), for example. Based on the plurality of times T2 at which the receivers 94 and 95 receives the ultrasonic waves, the CPU 61 computes a plurality of sets of the coordinates E0 of the plurality of positions on the bed surface 98 from which the transmitter 915 transmits the ultrasonic waves at the plurality of times every time the specified time period UT elapses after the switch 913 is turned on.

Transmitter Coordinate Computation Processing

Figure 10:
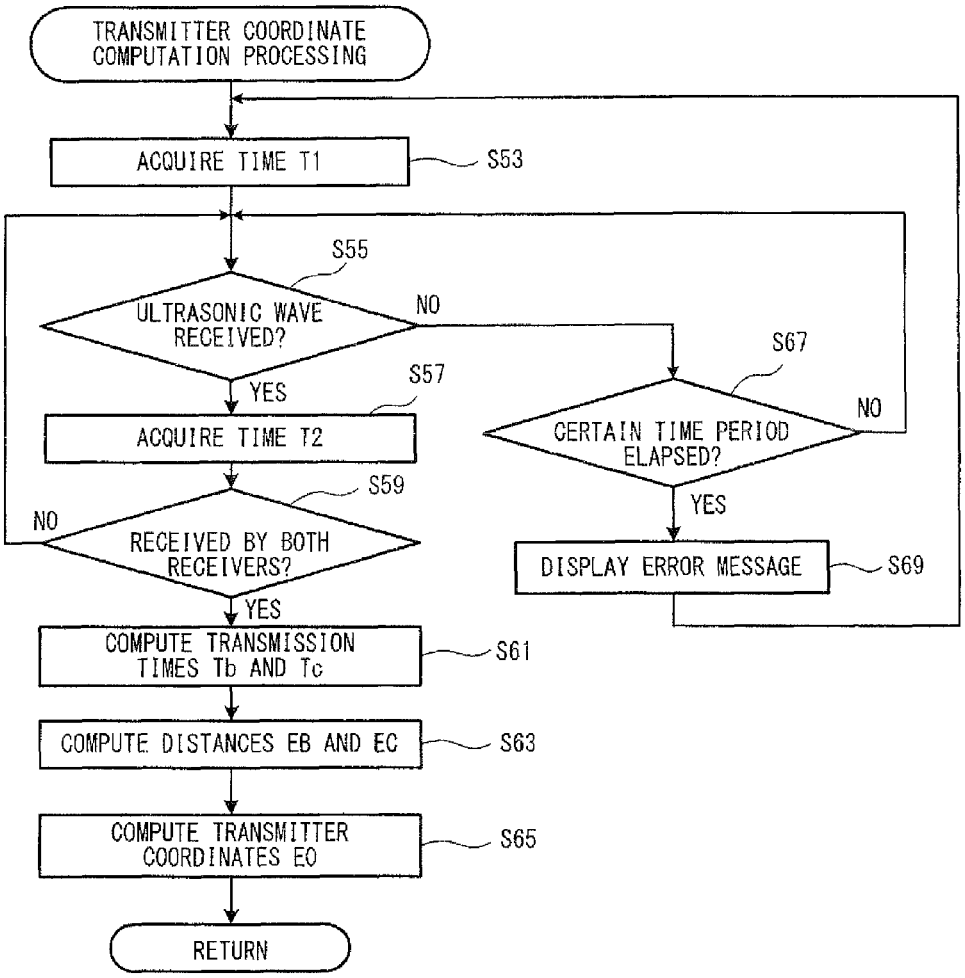
FIG. 10 is a flowchart showing transmitter coordinate computation processing.

The transmitter coordinate computation processing will be explained in detail with reference to FIG. 10. The CPU 61 starts the transmitter coordinate computation processing and advances the processing to step S53.

At step S53, the CPU 61, referring to the timer 27, examines the transmission times for the ultrasonic waves transmitted every time the specified time period UT elapses and identifies the transmission time that is the closest to the current time. The CPU 61 acquires the identified transmission time as the transmission time T1. The RAM 63 stores the acquired transmission time T1.

At step S55, the CPU 61 determines whether one of the receivers 94 and 95 has received the ultrasonic wave transmitted from the coordinate indicator 91. When it is determined that one of the receivers 94 and 95 has received the ultrasonic wave (yes at step S55), the CPU 61 advances the processing to step S57. When it is determined that neither of the receivers 94 and 95 has received the ultrasonic wave (no at step S55), the CPU 61 advances the processing to step S67. Specifically, when one of the receivers 94 and 95 has received the ultrasonic wave, a detection signal is output to the CPU 61 via the input/output interface 65. When the CPU 61 receives the detection signal, the CPU 61 determines that the ultrasonic wave has been received.

At step S67, the CPU 61 refers to the timer 27 and determines whether a certain time period has elapsed from the transmission time T1. The certain time period is a time period that is sufficient for the ultrasonic wave to reach the receivers 94 and 95 after the ultrasonic wave transmits from the coordinate indicator 91. The certain time period is 2 milliseconds, for example. When it is determined that the certain time period has elapsed (yes at step S67), the CPU 61 advances the processing to step S69. More specifically, the CPU 61 stands by for the certain time period until one of the receivers 94 and 95 receives the ultrasonic wave. For example, it is assumed that the ultrasonic wave transmitted from the transmitter 915 of the coordinate indicator 91 is shielded by a hand or an arm of the user, the work cloth 100, or the like and does not reach the receivers 94 and 95 for the certain time period or more. More specifically, when the certain time period has elapsed in a state in which at least one of the receivers 94 and 95 does not receive the ultrasonic wave, the CPU 61 advances the processing to step S69. When it is determined that the certain time period has not elapsed (no at step S67), the CPU 61 returns the processing to step S55.

At step S69, the CPU 61 controls the drive circuit 75 such that an error message is displayed on the LCD 10. The error message is a message that indicates that at least one of the receivers 94 and 95 was not able to receive the ultrasonic wave. When the user sees the error message, the user may indicate an arbitrary position on the work cloth 100 once again using the coordinate indicator 91. In order to once again detect the indication signal that is output from the signal output circuit board 914, the CPU 61 returns the processing to step S53 after the processing at step S69.

At step S57, the CPU 61 refers to the timer 27 and identifies the time at which the ultrasonic is received by one of the receivers 94 and 95. The RAM 63 stores the identified time as the reception time T2. The time at which the ultrasonic wave is received by one of the receivers 94 and 95 is, specifically, the time at which the CPU 61 receives the detection signal.

At step S59, the CPU 61 determines whether the ultrasonic wave has been received by both the receivers 94 and 95. When it is determined that the ultrasonic wave has been received by both the receivers 94 and 95 (yes at step S59), the CPU 61 advances the processing to step S61. When it is determined that one of the receivers 94 and 95 has not received the ultrasonic wave (no at step S59), the CPU 61 returns the processing to step S55.

At step S61, the CPU 61 computes the transmission times Tb and Tc. Specifically, the CPU 61 computes the transmission times Tb and Tc based on the transmission time T1 and the reception times T2. More specifically, the CPU 61 computes the transmission time Tb by subtracting the transmission time T1 from the reception time T2 for the receiver 94. The CPU 61 computes the transmission time Tc by subtracting the transmission time T1 from the reception time T2 for the receiver 95. The CPU 61 stores the transmission times Tb and Tc in the RAM 63.

At step S63, the CPU 61 computes the distances EB and EC between the transmitter 915 and the receivers 94 and 95, respectively, based on the transmission times Tb and Tc and the sound velocity VS, which is the velocity at which the ultrasonic wave travels. Specifically, the CPU 61 computes the distances EB and EC by multiplying the computed transmission times Tb and Tc by the sound velocity VS (refer to Equations (3) and (4)). The CPU 61 stores the distances EB and EC in the RAM 63.

At step S65, the CPU 61 computes the transmitter coordinates E0 of the transmitter 915 on the flat surface (the bed surface 98) by computing the transmitter coordinates E. Specifically, the CPU 61 computes the transmitter coordinates E (Xe, Ye, Ki) by applying the coordinates B (Xb, Yb, Zb), the coordinates C (Xc, Yc, Zc), the constant Ki, which is the height of the transmitter 915, and the distances EB and EC to Equations (5) and (6) and solving the simultaneous Equations (5) and (6). Accordingly, the coordinates E0 on the bed surface 98 are (Xe, Ye, 0). In this manner, the CPU 61 computes the coordinates E0 for the transmitter 915 on the work cloth 100 that is indicated by the coordinate indicator 91. The CPU 61 stores the transmitter coordinates E0 in the RAM 63. After the processing at step S65, the CPU 61 ends the transmitter coordinate computation processing and advances the processing to step S17 of the main processing shown in FIG. 9.

At step S17, the CPU 61 determines whether the switch 913 is on. When it is determined that the switch 913 is on (yes at step S17), the CPU 61 advances the processing to step S19. When it is determined that the switch 913 is not on (no at step S17), the CPU 61 advances the processing to step S23. While the switch 913 is on, the position of the indicator end 911 does not move due to friction with the work cloth 100. The inner wall of the hole of the transmitter 915 restricts the movement direction of the indicating member 942 to the longitudinal direction of the indicating member 942. While the switch 913 is on, the transmitter 915 may be moved by the distance Ls in the longitudinal direction. When the indicating member 942 is moved as far as possible to the other end side while the switch 913 is on, the distance between the transmitter 915 and the indicator end 911 is the distance Lr. The distance Ls and the distance Lr are known values. Therefore, the CPU 61 can compute the indicated point 936 using an equation of a proportional relationship with the movement distance on the bed surface 98 of the transmitter 915.

At step S19, the CPU 61 refers to the timer 27, and computes the coordinates E0, on the flat surface, of the transmitter 915 that transmitted the ultrasonic waves, based on the reception time T2 that is closest to the current time among the plurality of reception times T2 at which the receivers 94 and 95 received the ultrasonic waves. The CPU 61 stores the computed coordinates as the transmitter coordinates E0 in the RAM 63. At step S19, in a similar manner to the processing at step S15, the CPU 61 performs the transmitter coordinate computation processing shown in FIG. 10, and computes the transmitter coordinates E0.

At step S21, the CPU 61 determines whether at least a maximum number Pmax of sets of the transmitter coordinates E0 are computed from when the switch 913 is turned on at step S11. When the CPU 61 determines that at least the maximum number Pmax of sets of the transmitter coordinates E0 are computed from when the switch 913 is turned on (yes at step S21), the CPU 61 advances the processing to step S26. When the CPU 61 determines that at least the maximum number Pmax of sets of the transmitter coordinates E0 are not computed from when the switch 913 is turned on (no at step S21), the CPU 61 returns the processing to step S17. The maximum number Pmax is 100, for example. The ROM 62 stores the maximum number Pmax.

At step S23, the CPU 61 determines whether at least a minimum number Pmin of sets of the transmitter coordinates E0 are computed while the switch 913 is on. When the CPU 61 determines that at least the minimum number Pmin of sets of the transmitter coordinates E0 are computed while the switch 913 is on (yes at step S23), the CPU 61 advances the processing to step S26. When the CPU 61 determines that at least the minimum number Pmin of sets of the transmitter coordinates E0 are not computed while the switch 913 is on (no at step S23), the CPU 61 advances the processing to step S25. The minimum number Pmin is 20, for example. The ROM 62 stores the minimum number Pmin.

Generally, a time period during which the user indicates the indicated point 936 using the coordinate indicator 91, namely, a time period during which the switch 913 is on, is approximately 0.1 to 0.6 seconds. The time period during which the switch 913 is on is almost the same as the time period obtained by multiplying the specified time period UT by the number of sets of the transmitter coordinates E. Therefore, it is necessary for UT×Pmin to be larger than or equal to the minimum time period during which the user indicates the indicated point 936 using the coordinate indicator 91. Specifically, the minimum number Pmin needs to satisfy UT×Pmin≥0.1. In a case where the specified time period UT is 6 milliseconds, the minimum number Pmin is not less than 17. Further, in order for the CPU 61 to compute the movement distance Da of the transmitter 915, at least the two points, including the first point 931 and the second point 932, are necessary. Accordingly, the minimum number Pmin is not less than 2. Further, it is necessary for UT×Pmax to be larger than or equal to the maximum time period during which the user indicates the indicated point 936 using the coordinate indicator 91. Specifically, the maximum number Pmax needs to satisfy UT×Pmax≥0.6. In a case where the specified time period UT is 6 milliseconds, the maximum number Pmax is not less than 100. Under these conditions, the minimum number Pmin and the maximum number Pmax are set.

At step S25, the CPU 61 deletes, from the RAM 63, the transmitter coordinates E0 computed while the switch 913 is . By the processing at step S25, when the switch 913 is turned on next time, the previously computed transmitter coordinates E0 are not stored in the RAM 63. When the CPU 61 performs the main processing, it is not possible that the previously computed transmitter coordinates E0 are erroneously used for computation.

At step S26, the CPU 61 causes the transmitter 915 to end the ultrasonic wave transmission every time the specified time period UT elapses. The CPU 61 can compute the movement direction Ma and the movement distance Da, which will be described below, by computing the movement trajectory of the transmitter 915 while the switch 913 is on.

At step S27, the CPU 61 performs second point computation processing to compute the second point 932. The second point 932 represents the coordinates on the bed surface 98 of the transmitter 915 that is moved in the longitudinal direction closer to the indicator end 911 side than the first point 931 and transmits the ultrasonic wave. The second point 932 represents the coordinates on the bed surface 98 for the transmission position 9161 in a state in which the indicating member 942 is pressed and moved as far as possible to the other end side.

Second Point Computation Processing

Figure 12:
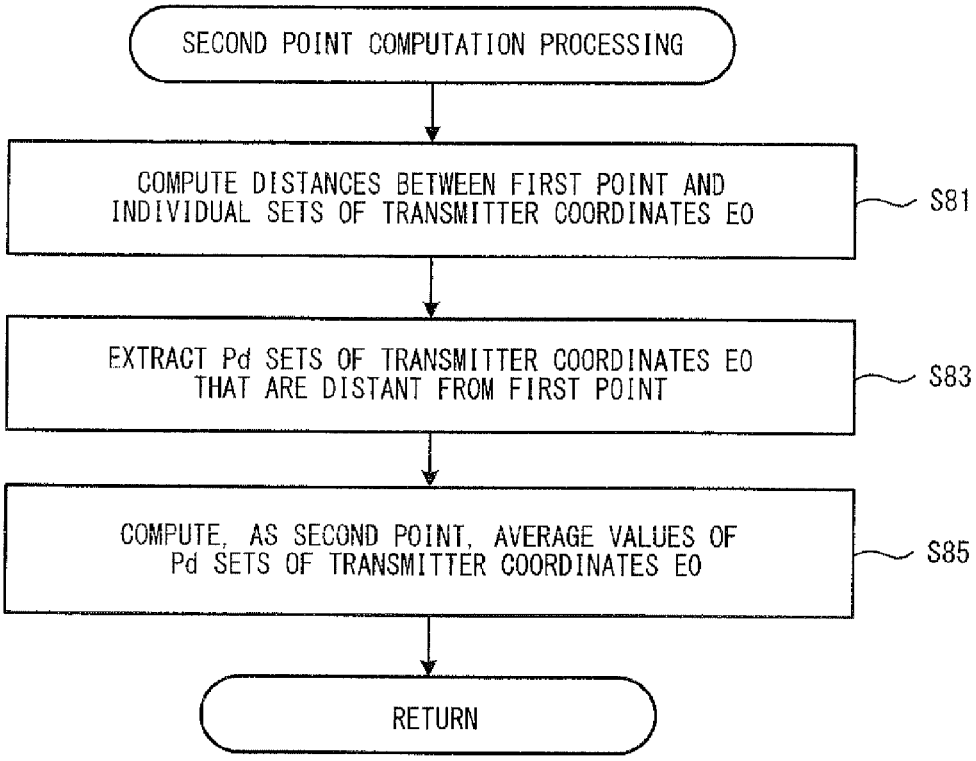
FIG. 12 is a flowchart showing second point computation processing.

The second point computation processing will be explained in detail with reference to FIG. 11 and FIG. 12. The CPU 61 starts the second point computation processing and advances the processing to step S81.

At step S81, the CPU 61 computes distances between the first point 931 computed at step S15 and the individual sets of the transmitter coordinates E0 computed at step S19. The CPU 61 stores the distances between the first point 931 and the individual sets of the transmitter coordinates E0 in the RAM 63. By the processing at step S81, the CPU 61 can extract a set of coordinates that are most distant from the first point 931.

At step S83, the CPU 61 extracts a predetermined number Pd of sets of the transmitter coordinates E0 from a first set of the transmitter coordinates E0, which correspond to the most distant point from the first point 931, to a Pd-th set of the transmitter coordinates E0, which correspond to Pd-th distant point from the first point 931. The predetermined number Pd is four, for example. When the predetermined number Pd is larger than the minimum number Pmin, the CPU 61 cannot compute the Pd-th set of the transmitter coordinates E0. Therefore, it is necessary for the predetermined number Pd to be at least less than the minimum number Pmin (20, for example). As shown in FIG. 11, the first set of the transmitter coordinates E0 that correspond the most distant point from the first point 931 are denoted by a black square mark. The transmitter coordinates E0 that correspond to the second set of the transmitter coordinates E0, which correspond to second distant from the first point 931, to the Pd-th set of the transmitter coordinates E0 are denoted by white square marks. Positions other than the predetermined number Pd of sets of the transmitter coordinates E0, the first point 931, and the coordinates 933 are denoted by triangular marks. The set of coordinates that correspond to the most distant point from the first point 931 indicates the coordinates on the bed surface 98 of the transmission position 9162 when the indicating member 942 is pressed and moved as far as possible to the other end side. By the processing at step S83, the CPU 61 can accurately compute the coordinates on the bed surface 98 of the transmission position 9162 when the indicating member 942 is pressed and moved as far as possible to the other end side.

At step S85, the CPU 61 computes average values of the Pd sets of the transmitter coordinates E0 that are distant from the first point 931 in the order from the first set of the transmitter coordinates E0. Specifically, each of the X coordinates, the Y coordinates, and the Z coordinates of the sets of the transmitter coordinates E0 are added, and each of the obtained sums is divided by the predetermined number Pd. In this manner, the average values of the coordinates are computed. The CPU 61 stores the average values in the RAM 63 as the second point 932. In FIG. 11, the second point 932 is denoted by a circular mark. The second point 932 is (6, 0, 0), for example. The CPU 61 ends the second point computation processing after the processing at step S85, and advances the processing to step S29 of the main processing shown in FIG. 9.

At step S29, the CPU 61 computes the movement direction Ma based on the plurality of sets of the transmitter coordinates E0 on the flat surface calculated at step S19. The movement direction Ma is a movement direction of the transmitter 915 on the bed surface 98 (the flat surface) when the transmitter 915 is moved along the longitudinal direction of the coordinate indicator 91 while the switch 913 is on. The CPU 61 computes the movement direction Ma based on the direction on the bed surface 98 from the first point 931 toward the second point 932, among the plurality of sets of the transmitter coordinates E0. By the processing at step S29, the CPU 61 can identify an extending direction in which the indicating member 942 extends from the transmission position 916. Therefore, the CPU 61 can compute the indicated point 936 based on the extending direction of the indicating member 942. The CPU 61 stores the direction on the bed surface 98 from the first point 931 toward the second point 932 in the RAM 63 as the movement direction Ma. The movement direction Ma is the X direction, for example.

At step S31, the CPU 61 computes the movement distance Da based on the plurality of sets of the transmitter coordinates E0 on the bed surface 98 (the flat surface) computed at step S19. The movement distance Da is a movement distance of the transmitter 915 on the bed surface 98 when the transmitter 915 is moved along the longitudinal direction of the coordinate indicator 91 while the switch 913 is on. Specifically, the CPU 61 computes the distance between the first point 931 computed at step S15 and the second point 932, as the movement distance Da. By the processing at step S31, the CPU 61 can identify the distance by which the indicating member 942 is pushed on the bed surface 98. The CPU 61 can compute the indicated point 936 using the extending direction of the coordinate indicator 91, the distance Ls by which the transmitter 915 is moved by the indicating member 942 being pressed and moved, and the distance Lr between the transmitter 915 and the indicator end 911 when the indicating member 942 is pushed as far as possible to the other end side. The CPU 61 stores the movement distance Da in the RAM 63. For example, the movement distance Da is obtained as the first point (8, 0, 0)−the second point (6, 0, 0)=(2, 0, 0). In this case, the movement distance Da is 2 mm.

At step S33, the CPU 61 performs indicated point computation processing. In the indicated point computation processing, the CPU 61 computes the coordinates of the indicated point 936 indicated by the indicating member 942, based on the plurality of sets of the transmitter coordinates E0 on the bed surface 98 computed at step S19, the movement direction Ma computed at step S29, and the movement distance Da computed at step S31.

Indicated Point Computation Processing

Figure 13:
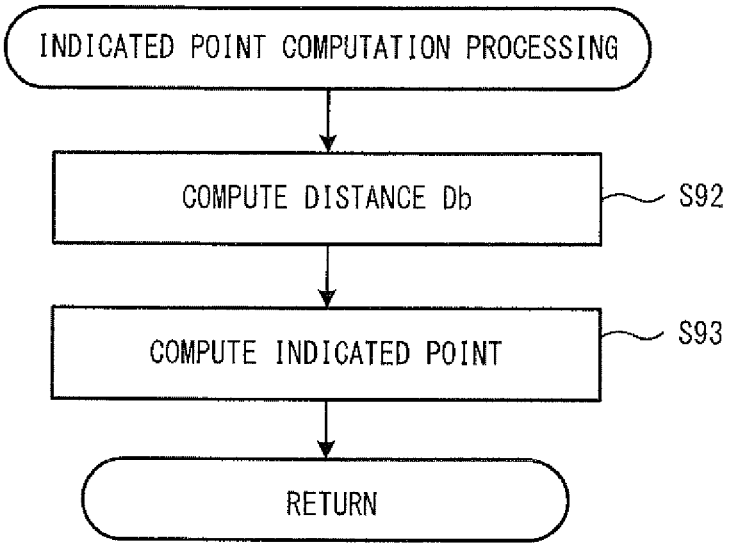
FIG. 13 is a flowchart showing indicated point computation processing.

The indicated point computation processing will be explained in detail with reference to FIG. 13. The CPU 61 starts the indicated point computation processing and advances the processing to step S92.

At step S92, the CPU 61 computes the distance Db on the bed surface 98 between the second point 932 and the indicated point 936, based on the movement distance Da, the distance Ls, and the distance Lr. The distance Ls is a distance in the longitudinal direction between the transmission position 9161 of the transmitter 915 that corresponds to the first point 931 and the transmission position 9162 of the transmitter 915 that corresponds to the second point 932. The distance Lr is a distance in the longitudinal direction between the indicated point 936 and the transmission position 9162 of the transmitter 915 that corresponds to the second point 932. The CPU 61 reads out the movement distance Da from the RAM 63, reads out the distances Lr and Ls in the longitudinal direction from the ROM 62, and computes the distance Db.

The distance Db may be computed using the following four prerequisites.

(1) While the switch 913 is on, the coordinates of the indicated point 936 indicated by the indicator end 911 do not change due to a frictional force between the indicator end 911 and the work cloth 100.

(2) While the switch 913 is on, the pressing direction in which the indicator end 911 presses the work cloth 100 does not change due to the frictional force between the indicator end 911 and the work cloth 100.

(3) The extending direction from the transmission position 916 to the indicator end 911 is parallel to the movement direction of the indicating member 942.

(4) The ratio between the distance in three-dimensional space and the distance on the flat surface does not change (Ls:Lr=Da:Db).

The distance Db is obtained as Db=(Lr×Da)/Ls. In the above-described example, the distance Db is obtained as (4×2)/2.5=3.2 [mm] The CPU 61 stores the computed distance Db in the RAM 63.

At step S93, the CPU 61 computes the coordinates of the indicated point 936 indicated by the indicating member 432, based on the plurality of sets of the transmitter coordinates E0 on the bed surface 98 computed at step S19, the movement direction Ma computed at step S29, and the distance Db computed at step S92. For example, in the computation of the indicated point 936, the CPU 61 uses the coordinates of the second point 932, among the plurality of sets of the transmitter coordinates E0 on the bed surface 98 computed at step S19. Based on the movement direction Ma, the CPU 61 can identify the extending direction from the transmission position 9161 to the indicator end 911. Further, based on the distance Db, the CPU 61 can identify the distance from the transmission position 9162 to the indicator end 911. Therefore, the CPU 61 can compute the coordinates of the indicated point 936. For example, it is assumed that the movement direction Ma is the X direction, as shown in FIG. 11. For example, it is assumed that the distance Db on the bed surface 98 between the indicated point 936 and the second point 932 is 3.2 mm. Also, for example, it is assumed that the second point 932 is (6, 0, 0). In this case, the coordinates of the indicated point 936 are (6−3.2, 0, 0)=(2.8, 0, 0). The CPU 61 stores the coordinates of the indicated point 936 in the RAM 63. After the processing at step S93, the CPU 61 ends the indicated point computation processing and advances the processing to step S35 of the main processing shown in FIG. 9.

At step S35, the CPU 61 deletes the transmitter coordinates E0 computed while the switch 913 is on, from the RAM 63. After the processing at step S35, the CPU 61 ends the main processing.

Effects of the Present Embodiment

At step S31, the CPU 61 computes the distance between the first point 931 and the second point 932 as the movement distance Da of the transmitter 915. The first point 931 is the position of the transmitter 915 on the flat surface when the transmitter 915 transmits the ultrasonic wave for the first time after the switch 913 is turned on. The second point 932 is the position of the transmitter 915 on the flat surface when the indicator end 911 is pushed as far as possible to the other end. The movement distance Da is proportional to the distance Ls by which the transmitter 915 is moved in the longitudinal direction by the indicating member 942 being pressed. The distance Db on the flat surface between the second point 932 and the indicated point 936 is proportional to the distance Lr between the indicated point 936 and the transmitter 915 when the indicating member 942 is pushed as far as possible to the other end side. In a case where the distances Ls and Lr are measured in advance and stored in the ROM 62 in advance, the CPU 61 may compute the coordinates of the indicated point 936 using these proportional relationships. In this manner, it is possible to accurately compute the coordinates of the indicated point using the single transmitter.

In the transmitter coordinate computation processing (step S15), the CPU 61 computes, as the first point 931, the coordinates on the bed surface 98 from which the transmitter 915 transmits the ultrasonic wave for the first time after the switch 913 is turned on. The point from which the transmitter 915 transmits the ultrasonic wave for the first time after the switch 913 is turned on is the position of the indicator end 911 when the indicator end 911 protrudes as far as possible to the one end side while the switch 913 is on. The CPU 61 sets average values of the Pd sets of the transmitter coordinates E0 that are distant from the first point 931 in the order from the first set of the transmitter coordinates E0 while the switch 913 is on, as the position of the indicator end 911 when the indicating member 942 is pushed as far as possible to the other end side. The distance Ls between the transmission position 9161 at which the indicator end 911 protrudes as far as possible to the one end side and the transmission position 9162 at which the indicator end 911 is pushed as far as possible to the other end side is a distance that may be easily measured by a person performing measurement. In a case where the measured distance Ls is stored in advance in the ROM 62, the CPU 61 may compute the coordinates of the indicated point 936 using the proportional relationship equation between the movement distance Da and the distance Ls.

In the second point computation processing (step S27), the CPU 61 computes, as the second point 932, the average values of the Pd sets of the transmitter coordinates E0 that are distant from the first point 931 in the order from the first set of the transmitter coordinates E0. The average values of the Pd sets of the transmitter coordinates E0 that are distant from the first point 931 in the order from the first set of the transmitter coordinates E0 are the position of the indicator end 911 when the indicator end 911 is pushed as far as possible to the other end side while the switch 913 is on. Further, the CPU 61 can more accurately compute the point at which the indicator end 911 is pushed as far as possible to the other end side, with reduced influence of error, by using the average values of the Pd sets of the transmitter coordinates E0 that are distant from the first point 931 in the order from the first set of the transmitter coordinates E0. The CPU 61 sets the first point 931 as the position of the indicator end 911 when the indicator end 911 protrudes as far as possible to the one end side while the switch 913 is on. Thus, the CPU 61 can compute the coordinates of the indicated point 936 using the proportional relationship equation with the movement distance Ls in the longitudinal direction of the transmitter 915 during the on state of the switch 913, which is stored in the ROM 62 in advance.

At step S63, the CPU 61 computes the distances EB and EC between the transmitter 915 and the receivers 94 and 95, based on the transmission times Tb and Tc and the sound velocity VS. At step S65, the CPU 61 computes the coordinates E that are distant from the receiver 94 by the distance EB and that are distant from the receiver 95 by the distance EC. In this manner, the CPU 61 can identify the coordinates E of the transmitter 915 by acquiring the transmission time T1 and the reception times T2.

At step S29, the CPU 61 computes the movement direction Ma of the transmitter 915 based on the direction from the first point 931 toward the second point 932. The first point 931 is the position of the transmitter 915 on the flat surface when the transmitter 915 transmits the ultrasonic wave for the first time after the switch 913 is turned on. The second point 932 is the position of the transmitter 915 on the flat surface when the indicator end 911 is pushed as far as possible to the other end side. The CPU 61 can identify the coordinates of the indicated point 936 using the computed movement direction Ma and the distance Db between the second point 932 and the indicated point 936.

At step S13, the CPU 61 causes the transmitter 915 to transmit the ultrasonic wave every time the specified time period UT elapses. Therefore, the transmission time T1 is uniquely determined. It is therefore possible to identify the coordinates of the indicated point 936 more accurately.

Modified Examples

The present disclosure is not limited to the above-described embodiment, and various modifications to the above-described embodiment are possible.

At step S92, the CPU 61 computes the distance Db on the bed surface 98 between the second point 932 and the indicated point 936, based on the movement distance Da, the distance Ls, and the distance Lr. The distance Ls is the distance in the longitudinal direction between the transmission position 9161 that corresponds to the first point 931 and the transmission position 9162 that corresponds to the second point 932. The distance Lr is the distance in the longitudinal direction between the indicated point 936 and the transmission position 9162 that corresponds to the second point 932. However, the CPU 61 may compute the distance on the bed surface 98 between the first point 931 and the indicated point 936, based on the movement distance Da, the distance Ls, and the distance (Lr+Ls) in the longitudinal direction between the indicated point 936 and the transmission position 9161 that corresponds to the first point 931. Then, the CPU 61 may compute the coordinates of the indicated point 936 based on the distance on the bed surface 98 between the first point 931 and the indicated point 936, the movement direction Ma, and the coordinates of the first point 931.

Figure 14:
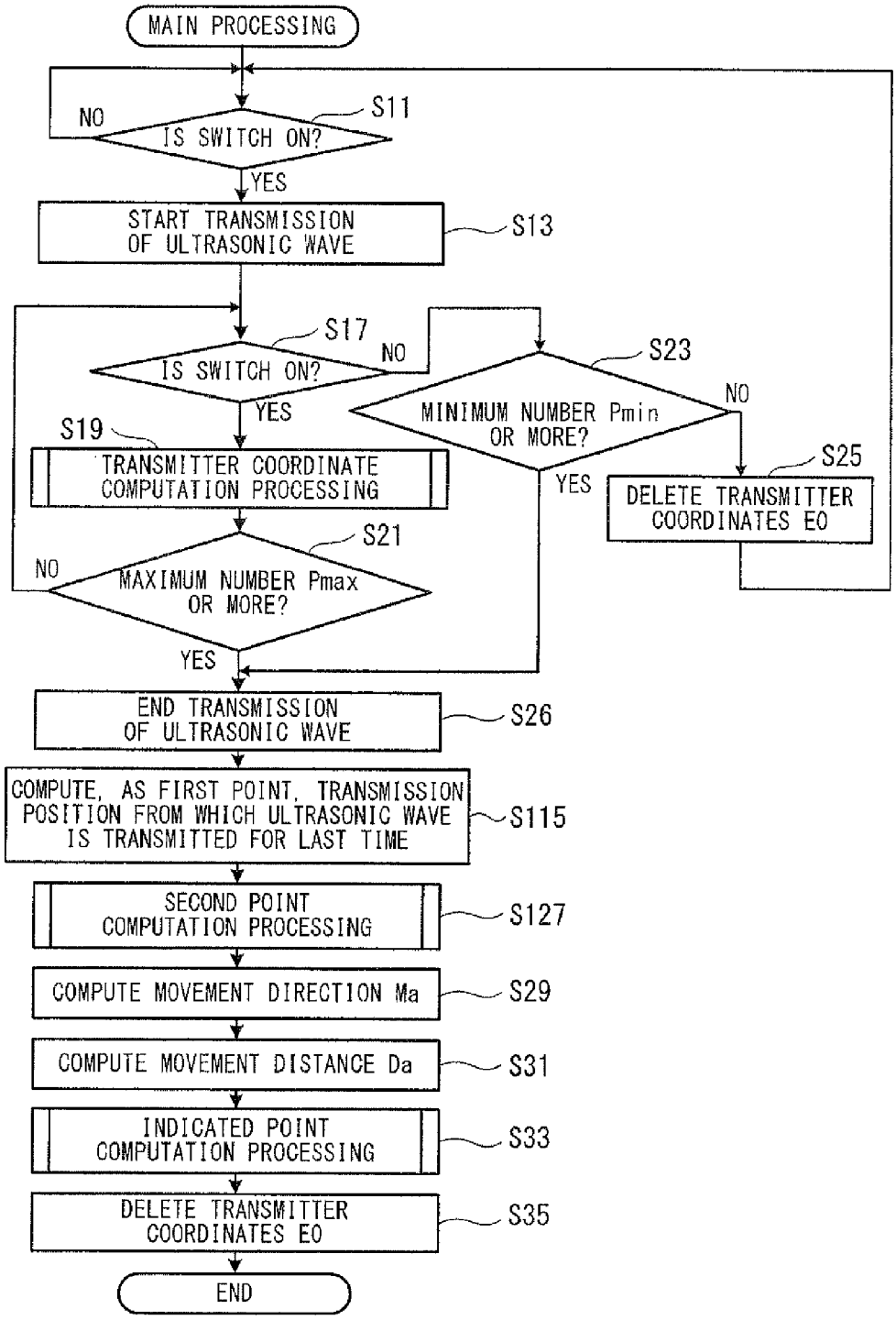
FIG. 14 is a flowchart showing main processing according to a modified example.

In the transmitter coordinate computation processing (step S15), the CPU 61 computes, as the first point 931, from among the plurality of sets of the coordinates E0, the coordinates on the bed surface 98 from which the transmitter 915 transmits the ultrasonic wave for the first time after the switch 913 is turned on. However, as in the processing at step S115 of main processing shown in FIG. 14, the CPU 61 may compute, as a first point 933, the coordinates on the bed surface 98 from which the transmitter 915 transmits the ultrasonic wave for the last time while the switch 913 is on. In the main processing shown in FIG. 14, processing at step S115 is introduced between step S26 and step S29, instead of the processing at step S15 of the main processing shown in FIG. 9. At step S115, the CPU 61 refers to the RAM 63 and computes the first point 933 based on the time at which the transmitter 915 transmits the ultrasonic wave for the last time. Specifically, from among the transmission times T1 stored in the RAM 63, the CPU 61 sets a most recently updated time and a second recently updated time as the transmission times at which the transmitter 915 transmits the ultrasonic wave for the last time while the switch 913 is on. Further, from among the reception times T2 stored in the RAM 63, the CPU 61 sets two most recently updated times as the reception times at which the receivers 94 and 95 receives the ultrasonic wave for the last time while the switch 913 is on. Then, the CPU 61 computes the first point 933 based on the transmission times T1 and the reception times T2, The point from which the transmitter 915 transmits the ultrasonic wave for the last time is the position of the transmitter 915 when the indicator end 911 protrudes as far as possible to the one end side while the switch 913 is on. After the processing at step S115, the CPU 61 advances the processing to step S127. The CPU 61 sets, as the second point 932, the position of the transmitter 915 when the indicator end 911 is pushed as far as possible to the other end side while the switch 913 is on. In a case where the distance Ls is stored in the ROM 62 in advance, the CPU 61 can compute the indicated point 936 using the proportional relationship equation between the movement distance from the second point 932 to the first point 933 and the distance Ls.

Figure 15:
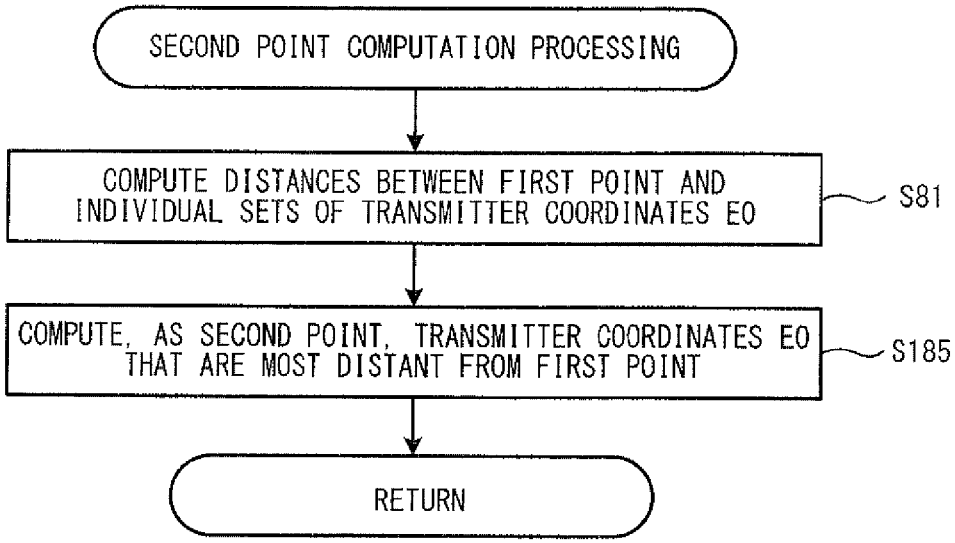
FIG. 15 is a flowchart showing second point computation processing according to a modified example.

In the second point computation processing (step S27), the CPU 61 computes, as the second point 932, the average values of the Pd sets of the transmitter coordinates E0 that are distant from the first point 931 in the order from the first set of the transmitter coordinates E0. However, as shown in second point computation processing (FIG. 15) that is performed at step S127 of the main processing shown in FIG. 14, the CPU 61 may compute one set of coordinates that are most distant from the first point 931, as a second point 934. In the main processing shown in FIG. 14, the second point computation processing (step S127) is introduced between step S26 and step S29, instead of the second point computation processing that is performed at step S27 of the main processing shown in FIG. 9. In the second point computation processing shown in FIG. 15, processing at step S185 is introduced after step S81, instead of step S85 and step S83 of the second point computation processing shown in FIG. 12. At step S185, the CPU 61 computes, as the second point 934, the coordinates that are most distant from the first point 931, based on the distances between the first point 931 computed at step S81 and individual sets of the transmitter coordinates E0. In FIG. 11, the coordinates that are most distant from the first point 931 are denoted by the black square mark. After the processing at step S185, the CPU 61 ends the second point computation processing (step S127), and advances the processing to step S29 of the main processing shown in FIG. 14. The coordinates that are most distant from the first point 933 represent the point at which the indicator end 911 is pushed as far as possible to the other end side while the switch 913 is on. The CPU 61 sets, as the first point 933, the position of the transmitter 915 when the indicator end 911 protrudes as far as possible to the one end side while the switch 913 is on. Thus, the CPU 61 can compute the indicated point 936 using the proportional relationship equation between the distance on the bed surface 98 from the second point 934 to the first point 933 and the movement distance Ls in the longitudinal direction of the transmitter 915, which is stored in the ROM 62 in advance.

At step S29, the CPU 61 computes the direction from the first point 931 toward the second point 932 as the movement direction Ma. However, the movement direction Ma may be computed using all the sets of the transmitter coordinates E0, instead of using only the first point 931 and the second point 932. For example, using the least squares method, the CPU 61 may compute an equation for a straight line that is closest to the first point 931, the second point 932, and the transmitter coordinates E0. Then, the CPU 61 may store the inclination of the straight line with respect to the X direction in the RAM 63 as the movement direction Ma.

Strictly speaking, the transmission position from which the transmitter 915 transmits the ultrasonic wave for the first time after the switch 913 is turned on is different from the position of the transmitter 915 when the switch 913 is turned on. Therefore, when it is assumed that the transmission position 9161 that corresponds to the first point 931 is the same as the point at which the switch 913 is turned on, an error occurs. Specifically, after the switch 913 is turned on, the signal output circuit board 914 outputs the indication signal to the CPU 61. When the CPU 61 receives the indication signal, the CPU 61 outputs, to the signal output circuit board 914, a control signal that commands the transmission of the ultrasonic wave. The signal output circuit board 914 causes the capacitor portion 950 to output energy toward the transmitter 915. The transmitter 915 receives the energy from the capacitor portion 950 and transmits the ultrasonic wave. In other words, the time at which the transmitter 915 transmits the ultrasonic wave for the first time after the switch 913 is turned on is after the time at which the switch 913 is turned on. Therefore, the transmission position of the transmitter 915 at the time at which the transmitter 915 transmits the ultrasonic wave for the first time after the switch 913 is turned on is located further to the other end side by a predetermined distance Lt than the transmission position of the transmitter 915 at the time at which the switch 913 is turned on. The predetermined distance Lt is 0.5 mm, for example. Therefore, in a case where the CPU 61 sets, as the transmission position 9161, the position that is closer to the one end side by the predetermined distance Lt from the position at which the switch 913 is turned on, the distance in the longitudinal direction between the transmission position 9161 that corresponds to the first point 931 and the transmission position 9162 that corresponds to the second point 932 becomes a more accurate value. It is thus possible to compute the coordinates of the indicated point 936 more accurately.

In the above-described embodiment, the two points of the first point 931 and the second point 932 are used to compute the movement direction Ma of the transmitter 915 and the movement distance Da of the transmitter 915. However, instead of using the two points, three or more points may be used to compute the movement direction Ma and the movement distance Da of the transmitter 915.

The sewing machine of the above-described embodiment is the sewing machine 101 including a single needle bar. However, a multi-needle sewing machine including a plurality of needle bars may be used.

In the above-described embodiment, the coordinate indicator 91 transmits the indication signal that indicates that the ultrasonic wave has been transmitted, to the sewing machine 101 via the cable 912. However, the coordinate indicator 91 may be configured to output an electromagnetic wave signal without using the cable 912. It is sufficient for the sewing machine 101 to detect the electromagnetic wave signal. In this case, the sewing machine 101 can identify the transmission time T1 based on the time at which the electromagnetic wave signal is detected.

In the above-described embodiment, the number of the receivers 94 and 95 is two. However, the sewing machine may be provided with three or more receivers. The sewing machine may identify the transmission position of the transmitter 915 based only on the detection times at which the respective receivers detect the ultrasonic waves.

In the above-described embodiment, the sound velocity VS is stored in advance in the ROM 62. The sound velocity VS varies depending on an ambient temperature. For example, a temperature detector, such as a thermistor, may be provided on the sewing machine in order to measure temperature. In this case, the sewing machine may compute the distances from the transmitter 915 to the receivers 94 and 95 using the sound velocity VS that corresponds to the ambient temperature.

In the above-described embodiment, software that is executed by the CPU 61 realizes the processing that computes the coordinates from which the ultrasonic waves are transmitted, the processing that computes the movement direction Ma, the processing that computes the movement distance Da, the processing that computes the coordinates of the indicated point 936, the processing that computes the distances EB and EC between the transmitter 915 and the receivers 94 and 95, and the processing that computes the distance on the bed surface 98 between the first point 931 or the second point 932 and the indicated point 936. However, each of the processing may be realized by hardware. In the above-described embodiment, the CPU 61 performs the processing at each step. However, another CPU may perform at least part of the processing. One or a plurality of application specific integrated circuits (ASICs) may perform at least part of the processing.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a coordinate indicator comprising:

a cylindrical housing;

a rod-shaped indicating member including an indicator end, the indicator end being configured to indicate an indicated point, the indicating member being configured to be housed in the housing, the indicating member being configured to be pressed to move along a longitudinal direction of the housing, and the indicating member being configured such that the indicator end protrudes from one end of the housing in the longitudinal direction;

a switch housed in the housing, the switch being configured to be turned on when the indicating member is pressed;

a single transmitter housed in the housing, the transmitter being configured to transmit an ultrasonic wave a plurality of times while the switch is on;

a receiver configured to receive the ultrasonic wave transmitted by the transmitter; and a flat surface configured to be indicated by the indicator end;

a processor; and a memory configured to store computer-readable instructions, wherein the computer-readable instructions, when executed by the processor, cause the sewing machine to perform processes comprising:

computing a plurality of sets of first coordinates based on a plurality of times at which the receiver receives the ultrasonic wave, the plurality of sets of the first coordinates being coordinates of a plurality of positions, on the flat surface, of the transmitter that transmits the ultrasonic wave;

computing a movement direction based on at least some of the computed plurality of sets of the first coordinates, the movement direction being a movement direction of the transmitter on the flat surface in which the transmitter is moved along the longitudinal direction while the switch is on;

computing a movement distance based on at least some of the computed plurality of sets of the first coordinates, the movement distance being a movement distance on the flat surface by which the transmitter is moved along the longitudinal direction while the switch is on; and computing second coordinates based on at least some of the plurality of sets of the first coordinates, the movement direction, and the movement distance, the second coordinates being coordinates of the indicated point, and the indicated point being a position on the flat surface indicated by the indicator end.

2. The sewing machine according to claim 1, wherein the computing of the plurality of sets of the first coordinates includes:

computing a first point that indicates coordinates, on the flat surface, of the transmitter that transmits the ultrasonic wave while the switch is on; and computing a second point that indicates coordinates, on the flat surface, of the transmitter that is moved in the longitudinal direction closer to a side of the indicated point than the first point and that transmits the ultrasonic wave, and the computing of the movement distance includes:

computing, as the movement distance, a distance between the computed first point and the computed second point.

3. The sewing machine according to claim 2, wherein the computing of the second coordinates includes:

computing a third distance based on the movement distance, a first distance, and a second distance, the first distance being a distance in the longitudinal direction between the transmitter that corresponds to the first point and the transmitter that corresponds to the second point, the second distance being a distance in the longitudinal direction between the indicated point and the transmitter that corresponds to the second point, and the third distance being a distance on the flat surface between the indicated point and one of the first point and the second point; and computing the second coordinates based on the movement direction and the computed third distance.

4. The sewing machine according to claim 2, wherein the computing of the first point includes:

computing, as the first point, a point that indicates coordinates, on the flat surface, of the transmitter at a time at which the transmitter first transmits the ultrasonic wave, among a plurality of times at which the transmitter transmits ultrasonic wave while the switch is on.

5. The sewing machine according to claim 2, wherein the computing of the first point includes:

computing, as the first point, a point that indicates coordinates, on the flat surface, of the transmitter at a time at which the transmitter transmits the ultrasonic wave for a last time, among a plurality of times at which the transmitter transmits ultrasonic wave while the switch is on.

6. The sewing machine according to claim 2, wherein the computing of the second point includes:

computing, as the second point, a point that indicates a set of coordinates that are most distant from the first point among the plurality of sets of the first coordinates.

7. The sewing machine according to claim 2, wherein the computing of the second point includes:

extracting, from among the plurality of sets of the first coordinates, coordinates of a plurality of positions that are distant from the first point; and computing average values of the extracted coordinates of the plurality of positions, as the set of coordinates indicated by the second point.

8. The sewing machine according to claim 2, wherein the computing of the movement direction includes:

computing the movement direction on the flat surface in which the transmitter is moved, based on a direction on the flat surface from the first point toward the second point.

* * * * *